US007062188B2

(12) United States Patent
Tatematsu et al.

(10) Patent No.: US 7,062,188 B2
(45) Date of Patent: Jun. 13, 2006

(54) IMAGE HEATING DEVICE, IMAGE FORMING APPARATUS, IMAGE COPYING MACHINE, AND METHOD FOR CONTROLLING TEMPERATURE

(75) Inventors: Hideki Tatematsu, Ashiya (JP); Kenji Asakura, Kyoto (JP); Masaru Imai, Hirakata (JP); Tadafumi Shimizu, Ogoori (JP); Masahiro Samei, Fukuoka (JP); Keiichi Matsuzaki, Kurume (JP); Kazunori Matsuo, Oonojo (JP); Shoichi Kitagawa, Fukuoka (JP)

(73) Assignee: Matsushita Electric Industrial Co. Ltd., Osaka (JP)

( * ) Notice: Subject to any disclaimer, the term of this patent is extended or adjusted under 35 U.S.C. 154(b) by 0 days.

(21) Appl. No.: 11/191,590

(22) Filed: Jul. 28, 2005

(65) Prior Publication Data

US 2005/0260008 A1 Nov. 24, 2005

Related U.S. Application Data

(62) Division of application No. 10/374,619, filed on Feb. 25, 2003, now Pat. No. 6,968,137.

(30) Foreign Application Priority Data

Feb. 28, 2002 (JP) ..... 2002-053133

(51) Int. Cl.
*G03G 15/20* (2006.01)

(52) U.S. Cl. ..... 399/70; 219/619; 399/69

(58) Field of Classification Search ..... 399/70, 399/67, 69, 329, 336; 219/619, 636, 216
See application file for complete search history.

(56) References Cited

U.S. PATENT DOCUMENTS

| | | | | |
|---|---|---|---|---|
| 5,436,430 | A | 7/1995 | Baruch et al. | |
| 5,464,964 | A | 11/1995 | Okuda et al. | |
| 5,579,098 | A | 11/1996 | Noguchi et al. | |
| 5,839,042 | A | 11/1998 | Tomatsu | |
| 6,018,140 | A | 1/2000 | Hirose et al. | |
| 6,021,303 | A | 2/2000 | Terada et al. | |
| 6,141,511 | A | 10/2000 | Nakayama | |
| 6,175,699 | B1 | 1/2001 | Kato et al. | |
| 6,181,890 | B1 | 1/2001 | Kataoka et al. | |
| 6,298,215 | B1 | 10/2001 | Nomura et al. | |
| 6,321,047 | B1 | 11/2001 | Takata | |
| 6,438,348 | B1 | 8/2002 | Kobaru et al. | |
| 6,529,696 | B1 * | 3/2003 | Kuwabara | 399/69 |
| 6,671,470 | B1 | 12/2003 | Suzuki et al. | |

FOREIGN PATENT DOCUMENTS

| | | |
|---|---|---|
| EP | 0436955 | 7/1991 |
| EP | 0957412 | 11/1999 |
| JP | 6-149102 | 5/1994 |
| JP | 7-121050 | 5/1995 |
| JP | 9-230738 | 9/1997 |
| JP | 9-297486 | 11/1997 |
| JP | 9-325643 | 12/1997 |
| JP | 2000-66541 | 3/2000 |
| JP | 2000-147852 | 5/2000 |
| JP | 2000-250338 | 9/2000 |
| JP | 2001-66944 | 3/2001 |
| JP | 2001-100588 | 4/2001 |

* cited by examiner

*Primary Examiner*—Susan Lee
(74) *Attorney, Agent, or Firm*—Hamre, Schumann, Mueller & Larson, P.C.

(57) ABSTRACT

An image heating device is operational to estimate a temperature of a pressure roller so as to determine a set temperature for a roller belt in a subsequent image heating period.

28 Claims, 11 Drawing Sheets

| Medium | Resolution | Printing mode | Processing speed | Fixing temperature |
|---|---|---|---|---|
| Plain paper (16lb~19lb) | 600 | Color | 100mm/s | 165℃ |
| Plain paper (20lb~28lb) | 600 | Color | 100mm/s | 170℃ |

FIG. 5A

| Medium | Resolution | Printing mode | Processing speed | Fixing temperature |
|---|---|---|---|---|
| Plain paper (16lb~19lb) | 600 | Color | 100mm/s | 160℃ |
| Plain paper (20lb~28lb) | 600 | Color | 100mm/s | 167℃ |

FIG. 5B

| Medium | Resolution | Printing mode | Processing speed | Fixing temperature |
|---|---|---|---|---|
| Plain paper (16lb~19lb) | 600 | Color | 100mm/s | 155℃ |
| Plain paper (20lb~28lb) | 600 | Color | 100mm/s | 163℃ |

FIG. 5C

| | Time for cooling from 150°C to 120°C | NN(15°C≦) | | | LL(<15°C) | | |
|---|---|---|---|---|---|---|---|
| | | PO | Th | Tl | PO | Th | Tl |
| Mode 0 | - | 50W equivalent | 100°C | 97°C | 63W equivalent | 92°C | 87°C |
| Mode 1 | $t_p$ <10sec. | 900W equivalent | 130°C | 110°C | 900W equivalent | 130°C | 110°C |
| Mode 2 | 10sec. ≦ $t_p$ <20sec. | 130W equivalent | 100°C | 97°C | 130W equivalent | 92°C | 87°C |
| Mode 3 | 20sec. ≦ $t_p$ <30sec. | 100W equivalent | 100°C | 97°C | 100W equivalent | 92°C | 87°C |
| Mode 4 | 30sec. ≦ $t_p$ | 60W equivalent | 100°C | 97°C | 60W equivalent | 92°C | 87°C |

FIG. 7

IMAGE HEATING DEVICE, IMAGE FORMING APPARATUS, IMAGE COPYING MACHINE, AND METHOD FOR CONTROLLING TEMPERATURE

This application is a Division of application Ser. No. 10/374,619, filed Feb. 25, 2003, now U.S. Pat. No. 6,968,137, which application is incorporated herein by reference.

BACKGROUND OF THE INVENTION

1. Field of the Invention

The present invention relates to an image heating device that is suitable as a fixing device for fixing an unfixed toner image by heating a conductive belt directly or indirectly via a metal roller utilizing electromagnetic induction; an image forming apparatus, such as an electrophotographical apparatus or an electrostatic recording apparatus, using such an image heating device; an image copying machine using such an image forming apparatus; and a method for controlling temperature applicable to such an image heating device, an image forming apparatus, and an image copying machine.

2. Related Background Art

As image heating devices typically used for fixing devices, contact-heating type image heating devices such as roller-heating type devices and belt-heating type devices generally have been used.

In recent years, due to the demand for shorter warm-up time and reduced energy consumption, electromagnetic induction heating, by which rapid heating and high efficiency heating are likely to be attained, are attracting great attention. In the belt-heating type image heating devices, to shorten the warm-up time, a conductive belt having a smaller thermal capacity is used. A high-frequency current is applied to a magnetization coil to generate a high-frequency magnetic field, which causes an induced eddy current to be generated in the conductive belt, thereby causing Joule heat to be generated in the conductive belt itself. An unfixed toner image formed on a recording medium (paper, an OHP film, etc.) can be fixed after passing through a nip portion formed between a fixing roller and a pressure roller, which are pressed against with each other via the conductive belt that generates heat.

On the other hand, in the roller-heating type image heating devices, to shorten the warm-up time, a metal roller having a smaller thickness is used. A high-frequency current is applied to a magnetization coil to generate a high-frequency magnetic field, which causes an induced eddy current to be generated in the metal roller, thereby causing Joule heat to be generated in the metal roller. An unfixed toner image formed on a recording medium (paper, an OHP film, etc.) can be fixed after passing through a nip portion formed between the metal roller and the opposing pressure roller or between a fixing roller, to which heat conducted from the metal roller is transferred via a heat-resistant resin belt, and the opposing pressure roller.

In belt-type image heating devices (devices using a conductive belt or resin belt), a conductive belt having a small thermal capacity is heated through electromagnetic induction (direct heating of the belt), or a metal roller is heated through electromagnetic induction and the heat generated by the roller is conducted to a resin belt having a small thermal capacity (indirect heating of the belt). Thus, although the belt itself can be heated rapidly, a pressure roller having a large thermal capacity is heated slowly. Accordingly, in an early stage of the device operation, the temperature of the pressure roller is not sufficiently high while the belt already has reached a fixing temperature. Furthermore, if an intermittent printing operation is carried out continuously, the temperature of the pressure roller rises, and consequently, temperature fluctuations of the pressure roller become large. As a result, a toner image previously fixed and a toner image later fixed have a difference in gloss, or worse, fixing defects occur.

To solve such problems, in a conventional image heating device, it is necessary to provide a temperature sensor for detecting a temperature of a pressure roller in addition to a temperature sensor for detecting a temperature of the belt, so that the temperature of the pressure roller is taken into consideration when a fixing temperature is set. This configuration is intended to control an amount of heat generated by a heat-generating member according to the temperature of the belt and the temperature of the pressure roller detected by the foregoing temperature sensors so that the amount of heat applied to a recording medium at a portion where the belt and the pressure roller are pressed against each other is maintained at a predetermined reference level (see, for example, JP 6(1994)-149102 A).

However, it is not a preferable solution to provide an extra temperature sensor to detect a temperature of a pressure roller that serves for pressing a toner image onto the recording medium, that does not contribute directly to the heating of the recording medium, and that absorbs heat from the belt, since this causes an increase in the cost.

Furthermore, in the case where a temperature sensor is provided for the pressure roller, the sensor has to be placed within a range of a sheet width since a significant temperature fluctuation due to the passage of a sheet occurs with the pressure roller, but a surface of the pressure roller could be scarred by the temperature sensor, which in a double-sided printing operation might cause a scar in an image on a reverse side of a sheet. This is a significant problem, particularly in the case where a color toner image is to be fixed, since in such a case a pressure roller is required to have the same releasing property as that of the fixing roller and hence the pressure roller has a hard surface made of fluorocarbon resin, etc., in many cases.

In a type in which a metal roller is heated and the heat is conveyed by a resin belt, a rotating operation of the metal roller is generally started after the metal roller is heated up to a predetermined temperature, so as to shorten warm-up time. However, since the metal roller can be heated rapidly according to the electromagnetic induction heating, if the metal roller at rest is heated in the image heating device with a small thermal capacity, an abrupt temperature rise may occur partially. This may result in deterioration of the resin belt, an elastic material provided on the resin belt, and the like.

Especially in an image heating device performing heating with a metal roller and a resin belt looped around the roller, the temperature of the metal roller being made too high by the rapid heating results in a permanent deformation of the belt due to wrapping in accordance with the curvature of the roller. It is to be noted here that this problem seldom occurs in the case of a conductive belt and never occurs in a configuration in which a straight portion of the belt is heated. This problem occurs significantly only in a configuration in which a metal roller is heated and the heat from the roller is conveyed by the resin belt.

Furthermore, from the viewpoint of saving energy, it is preferable that a heat-generating member (conductive belt or metal roller) in an image heating device is heated only when the device is used. Image heating devices of the heat roller type generally include a heat-generating member at a nip portion. However, in image heating devices of the belt type, a heat-generating member is away from a nip portion, that is, a heat-generating portion of the conductive belt is away from a nip portion, or a metal roller that a resin belt is looped around is away from a nip portion, resulting in a time lag (thermal gradient) between a temperature change in the heat-generating portion of the conductive belt or in the heated portion of the resin belt, and a temperature change in the nip portion.

Furthermore, in order to respond to a print request from the user promptly, it is necessary to carry out preheating even during a stand-by period. However, in order to overcome the problem such as the wrapping or deterioration of the belt, which occurs when the belt is heated in a static state since the belt is heated rapidly to an extraordinarily high temperature, and to shorten as much as possible a time lag of a temperature change in the nip portion from a temperature change in the heat-generating portion of the conductive belt or the heated portion of the resin belt, the rotation of the conductive belt or the metal roller has to be continued even during the stand-by period. This is not preferable from the viewpoint of the energy saving or the suppression of noise caused by the rotation of the belt.

SUMMARY OF THE INVENTION

Therefore, with the foregoing in mind, it is an object of the present invention to provide: an image heating device configured so that a temperature sensor for detecting the temperature of the pressure roller is omitted for reduction of the cost, and hence configured to estimate the temperature of the pressure roller according to the temperature of the belt and a variation in the temperature of the same so as to set an optimal fixing temperature for a subsequent image heating operation, so that differences in glossiness among fixed images on recording media that occur due to a temperature fluctuation of the pressure roller, and the wrapping of the fixing belt and the like at a high temperature can be prevented. The device also can be configured to perform a preheating operation requiring a minimum belt rotation according to a variation in the temperature of the belt, during a stand-by time until a subsequent image heating operation is started so that the fast print time can be shortened with the reduction of noise and the energy saving taken into consideration. The invention also is directed to an image forming apparatus using such an image heating device; an image copying machine using such an image forming apparatus; and a method for controlling temperature applicable to such an image heating device, an image forming apparatus, and an image copying machine.

To achieve the foregoing object, a first image heating device according to the present invention includes a movable heating member for directly heating a material to be heated (a recording sheet, an OHP film, etc.); heat-generating means for directly or indirectly heating the heating member; pressing means arranged in contact with the heating member; a temperature sensor for detecting a temperature of the heating member; and controlling means for controlling an amount of heat generated by the heat-generating means according to the temperature of the heating member detected by the temperature sensor so that the heating member has a set temperature. In the foregoing first image heating device, the controlling means estimates a temperature of the pressing means according to at least one of the detected temperature of the heating member and a variation with time in the detected temperature after the heating of the heating member by the heat-generating means is stopped, so as to determine the set temperature for the heating member in a subsequent image heating period.

In the foregoing first image heating device, a temperature sensor for detecting a temperature of the pressing means (pressure roller) is omitted for reducing the cost, and the temperature of the pressure roller is estimated according to the temperature of the heating means (belt) or the variation in the temperature so as to optimally determine the set temperature for a subsequent image heating. With this configuration, irregularities in gloss in fixed images due to a temperature fluctuation of the pressure roller, and the wrapping of a sheet of paper to the fixing belt at a high temperature can be prevented.

In the first image heating device, the heating member is at least partially conductive (conductive belt), and the heat-generating means includes a magnetization means that directly heats the heating member through electromagnetic induction. Alternatively, the heat-generating means includes a rotatable heat-generating member (for instance, a metal roller) for indirectly heating the heating member (for instance, a heat-resistant resin belt) that is at least partially conductive and arranged in contact with an inner peripheral surface of the heating member, and magnetization means that heats the heating member through electromagnetic induction.

Furthermore, in the first image heating device, the heating member (belt) preferably has a thermal capacity of not more than 60 J/K, further preferably not more than 40 J/K.

In the case where the thermal capacity of the belt is set to be not more than 60 J/K, it is estimated that the heating of the belt by the heat-generating means with an applied electric power of 1000 W causes only one tenth or less of the belt to be heated actually in a static state, thereby raising the temperature of the belt up to 200° C. or above within a short time of approximately one second. Furthermore, in the case where the thermal capacity of the belt is set to be not more than 40 J/K, the heating of the belt by the heat-generating means an with applied electric power of 900 W raises the temperature of the belt up to several hundreds of degrees Celsius or above within a short time of approximately one second.

Furthermore, in the first image heating device, it is preferable that in the case where the detected temperature of the heating member (belt) is not lower than a predetermined temperature (for instance, 120° C.), the controlling means determines the set temperature for the heating member in the subsequent image heating period according to a variation with time in the detected temperature of the heating member. Also it is preferable that in the case where the detected temperature of the heating member is lower than the foregoing predetermined temperature, the controlling means determines the set temperature for the heating member in the subsequent image heating period according to the detected temperature of the heating member.

Furthermore, it is preferable that the controlling means determines the set temperature for the heating member in the subsequent image heating period according to a relationship between a reference value of the temperature of the heating member that is preset corresponding to an elapsed time from completion of the heating of the heating member by the heat-generating means (cooling curve of the belt with respect to the elapsed time), and an actually measured value of the temperature of the heating member detected by the temperature sensor. In this case, it is preferable that in the case where the actually measured value is not lower than the reference value, the controlling means selects a first look-up table (look-up table for high temperature) that stores a first set temperature (for instance, 163° C.), and in the case where the actually measured value is lower than the reference value, the controlling means selects a second look-up table (look-up table for intermediate temperature) that stores a second set temperature (for instance, 167° C.) that is higher than the first set temperature. Furthermore, the reference value of the temperature of the heating member is expressed by a formula in which the elapsed time from completion of image heating is used as a parameter.

The temperature of the pressing means (pressure roller) does not exceed the temperature of the belt. Therefore, in the case where the detected temperature of the belt is lower than the predetermined temperature, for instance, 120° C., the temperature of the pressure roller also is estimated to be low. However, in the case where the detected temperature of the belt is not lower than the predetermined temperature, for instance, 120° C., the temperature of the pressure roller is estimated to be high in some cases, while low in other cases.

Therefore, in the case where the detected temperature of the belt is not higher than 120° C. using the predetermined temperature as a threshold value, the pressure roller temperature is estimated to be low according to the detected temperature of the belt immediately before the start of the subsequent image heating, and the set temperature is determined (at, for instance, 167° C. or 170° C.) by referring to the look-up table (Table B) for intermediate temperature (for instance, 71° C. to 120° C.) or the look-up table (Table A) for low temperature (for instance, not higher than 70° C.).

On the other hand, in the case where the detected temperature of the belt is higher than 120° C., the set temperature is determined in the following manner.

In the case where a variation in the detected temperature of the belt with respect to an elapsed time (tp) from the completion of previous image heating to immediately before the start of subsequent image heating is small, that is, the detected temperature of the belt at the elapsed time tp is expressed by a formula in which the elapsed time tp is a parameter and it is higher than the cooling curve (threshold temperature Tf) of the belt that is preset, the temperature of the pressure roller is estimated to be high, the first look-up table (table C, for high temperature) is selected, and the set temperature is determined at the first set temperature (for instance, 163° C.) that is stored in the first look-up table. In contrast, in the case where a variation in the detected temperature of the belt with respect to an elapsed time tp is large, that is, the detected temperature of the belt at the elapsed time tp is lower than the cooling curve (threshold temperature Tf) of the belt, the temperature of the pressure roller is estimated to be low, the second look-up table (table B, for high temperature) is selected, and the set temperature is determined at the second set temperature (for instance, 167° C.) that is stored in the second look-up table and is higher than the first set temperature.

Thus, by selecting an optimal look-up table according to a cooled state of the belt, it is possible to estimate the temperature of the pressure roller according to the temperature of the belt or the variation in the temperature thereof so as to set an optimal fixing temperature, without providing a temperature sensor for detecting the temperature of the pressure roller.

Furthermore, in the first image heating device, it is preferable that the determination of the relationship between the reference value and the actually measured value is not carried out during a predetermined period (for instance, two seconds) from the suspension of the heating of the heating member by the heat-generating means. This is because in the case where the temperature sensor is composed of a thermistor, for instance, a difference between the detected temperature of the belt (actually measured value) and the threshold temperature (reference value) is smaller than a resolution of the thermistor, and, hence it is impossible to determine the relationship between the detected temperature and the threshold temperature accurately.

Furthermore, in the first image heating device, it is preferable that after a predetermined time (for instance, 180 seconds) elapses from completion of previous image heating, the controlling means determines the set temperature for the heating member in the subsequent image heating period according to the detected temperature of the heating member.

After a predetermined time (for instance, 180 seconds) elapses from the completion of the previous image heating operation, a difference between the temperature of the belt and that of the pressure roller has decreased already. Therefore, if the temperature of the belt is high, the temperature of the pressure roller is assumed to be high, and if the temperature of the belt is low, the temperature of the pressure roller is assumed to be low. Accordingly, the set temperature is determined simply according to the detected temperature of the belt.

The first image heating device preferably includes a cover for enclosing a space occupied by at least a part of the heating member (belt), the temperature sensor, and the pressing means (pressure roller) excluding a path portion through which the material to be heated (paper, an OHP film, etc.) passes, so as to make the temperature of the heating member detected by the temperature sensor substantially coincide with an ambient temperature in the vicinity of the temperature sensor.

This configuration makes the detected temperature of the belt coincide with the ambient temperature, thereby preventing the temperature of the pressure roller from rising to above the temperature of the belt. Thus, it is possible to estimate the temperature of the pressure roller appropriately.

To achieve the aforementioned object, a second image heating device according to the present invention includes a movable heating member (belt) for directly heating a material to be heated (recording sheet, OHP film); heat-generating means for directly or indirectly heating the heating member; pressing means arranged in contact with the heating member; a temperature sensor for detecting a temperature of the heating member; and controlling means for controlling an amount of heat generated by the heat-generating means according to the temperature of the heating member detected by the temperature sensor so that the heating member has a set temperature. The controlling means determines a preheating mode for the heating member in a stand-by period until a subsequent start of image heating, according to at least one of the detected temperature of the heating member and a variation with time in the detected temperature after the heating of the heating member by the heat-generating means is stopped.

In the second image heating device, a temperature sensor for detecting a temperature of the pressing means (pressure roller) is omitted for reducing the cost, and an optimal preheating mode for the belt is selected for preheating the belt in a stand-by period until a subsequent start of image heating, so that the fast print time is shortened.

In the second image heating device, the heating member is at least partially conductive (conductive belt), and the heat-generating means includes a magnetization means that directly heats the heating member through electromagnetic induction. Alternatively, the heat-generating means includes a rotatable heat-generating member (for instance, a metal roller) for indirectly heating the heating member (for instance, a heat-resistant resin belt) that is at least partially conductive and arranged in contact with an inner peripheral surface of the heating member, and magnetization means that heats the heating member through electromagnetic induction.

Furthermore, in the second image heating device, the heating member (belt) preferably has a thermal capacity of not more than 60 J/K, further preferably not more than 40 J/K. With this configuration, the same effect and function as those of the first image heating device can be achieved.

Furthermore, in the second image heating device, it is preferable that in the case where the variation with time in the detected temperature of the heating member (belt) exceeds a predetermined value (for example, the cooling time tp for cooling from 150° C. to 120° C. is less than 10 seconds, that is, the variation in the temperature is not less than 3 deg/sec.), the controlling means selects as the preheating mode a first preheating mode (Mode 1) in which application of electric power to the heat-generating means and suspension of the same are carried out in a state in which the heating member is moved, so that the detected temperature by the temperature sensor rises and falls between a first upper limit temperature (for instance, 130° C.) and a first lower limit temperature (for instance, 110° C.). In this case, it is preferable that the controlling means continuously maintains the state in which the heating member is moved, during a predetermined period (for example, at 50 mm/sec., ten turns), and sets an electric power applied to the heat-generating means so that the electric power has a maximum peak value (for instance, 900 W) upon the application of the same.

With this configuration, in the case where the belt temperature rapidly falls after the completion of the previous image heating operation, the pressure roller is determined to be in a low temperature state, and the belt is rotated for a predetermined times with a maximum electric power being applied, so that the belt is preheated at temperatures between the first upper limit temperature (for instance, 130° C.) and the first lower temperature (for instance, 110° C.). By so doing, the belt can be caused to have the optimal preheating temperature within a short time with minimal requisite belt driving.

Furthermore, in the second image heating device, it is preferable that, in the case where the variation with time in the detected temperature of the heating member (belt) does not exceed a predetermined value (for instance, the cooling time tp for cooling from 150° C. to 120° C. is not less than 10 seconds, that is, the variation in the temperature is less than 3 deg./sec.), the controlling means selects as the preheating mode a second preheating mode (Mode 2, 3, or 4) in which application of electric power to the heat-generating means and suspension of the same are carried out in a state in which moving of the heating member is stopped, so that the detected temperature by the temperature sensor rises and falls between a second upper limit temperature (for instance, 100° C. or 92° C.) and a second lower limit temperature (for instance, 97° C. or 87° C.). In this case, it is preferable that the controlling means varies the second upper limit temperature and the second lower limit temperature according to environmental conditions (temperature, moisture), and varies a peak value of the electric power applied to the heat-generating means according to the variation with time in the detected temperature of the heating member, and that each time the application of the electric power to the heat-generating means and the suspension of the same are repeated, the controlling means reduces a peak value of the electric power applied to the heat-generating means with a certain scaling factor.

With this configuration, in the case where a decrease in the belt temperature from the completion of the previous image heating operation is small, the pressure roller is determined to be still hot, and the belt is preheated at a temperature between the second upper limit temperature (for instance, 100° C. or 92° C.) and the second lower limit temperature (for instance, 97° C. or 87° C.) with a reduced electric power (for instance, not more than 130 W) being applied in a state in which the belt is stopped. By so doing, it is possible to prevent noises caused by the driving of the belt from being generated abruptly and unnecessarily causing the user to have concerns, and hence, to achieve both the energy saving and the shortening of the fast print time. Furthermore, in the case where the ambient environment is normal temperature/normal moisture (NN environment), an optimal preheating operation can be carried out by setting the second upper limit temperature at 100° C. and the second lower limit temperature at 97° C. In the case where the ambient environment is low temperature/low moisture (LL environment), an optimal preheating operation can be carried out by setting the second upper limit temperature at 92° C. and the second lower limit temperature at 87° C. that are lower than those in the NN environment. Furthermore, by dividing the second preheating mode into Modes 2, 3, and 4 in a descending order of the variation with time in the detected temperature of the heating member, and setting the initially set applied electric power (P0) for Modes 2 to 4 so that it decreases in the stated order, and by carrying out the preheating control so that the initially set applied electric power P0 gradually decreases, further energy saving can be achieved.

Furthermore, in the second image heating device, it is preferable that in the case where the variation with time in the detected temperature of the heating member is within a predetermined range, the controlling means selects as the preheating mode a third preheating mode in which application of an electric power to the heat-generating means and suspension of the same in a state in which moving of the heating member is stopped, and the moving of the heating member, are carried out alternately. In this case, it is preferable that each time the application of the electric power to the heat-generating means and the suspension of the same are repeated, the controlling means reduces a peak value of the electric power applied to the heat-generating means with a certain scaling factor, and that the controlling means varies a peak value of the electric power applied to the heat-generating means according to environmental conditions.

With this configuration, by setting the third preheating mode as an intermediate mode between the above-described first preheating mode and second preheating mode, more accurate preheating control can be performed. Furthermore, by changing the setting of the second upper and lower limit temperatures according to whether the ambient environment is either the NN environment or the LL environment, optimal preheating according to the environmental conditions can be performed. Furthermore, by performing the preheating control so as to reduce the applied electric power gradually, further energy saving can be achieved.

The second image heating device preferably includes a cover for enclosing a space occupied by at least a part of the heating member, the temperature sensor, and the pressing means excluding a path portion through which the material to be heated passes, so as to make the temperature of the heating member detected by the temperature sensor substantially coincide with an ambient temperature in the vicinity of the temperature sensor.

With this configuration, as in the first image heating device, the detected temperature of the belt is made to coincide with the ambient temperature. Therefore, it is possible to prevent the temperature of the pressure roller from being raised to above the belt temperature, and hence, to estimate the temperature of the pressure roller appropriately.

To achieve the aforementioned object, a first image forming apparatus according to the present invention includes image forming means for forming an unfixed toner image onto a recording medium as an material to be heated and having the unfixed image carried thereon, and a fixing device for thermally fixing the toner image onto the recording medium, wherein the fixing device is the first or second image heating device.

With the foregoing configuration of the first image forming apparatus, it is possible to provide an image forming apparatus such as an electrophotographic device or an electrostatic recording device having the advantage of the first or second image heating device. In this configuration, the cover for making the detected temperature of the heating member substantially coincide with the ambient temperature in the vicinity of the temperature sensor is provided on the first or second image heating device.

To achieve the aforementioned object, a second image forming apparatus according to the present invention includes image forming means for forming an unfixed toner image according to the original image onto a recording medium as a material to be heated and having the unfixed image carried thereon, and a removable fixing device for thermally fixing the toner image onto the recording medium, wherein the fixing device is the first or second image heating device that does not have a cover. The image forming apparatus further includes a cover for enclosing a space occupied by at least a part of the heating member, the temperature sensor, and the pressing means excluding a path portion through which the material to be heated passes when the fixing device is attached, so as to make the temperature of the heating member detected by the temperature sensor substantially coincide with an ambient temperature in the vicinity of the temperature sensor.

With the foregoing configuration of the second image forming apparatus, it is possible to provide an image forming apparatus such as an electrophotographic device or an electrostatic recording device having the advantage of the first or second image heating device. In this configuration, the cover for making the detected temperature of the heating member substantially coincide with the ambient temperature in the vicinity of the temperature sensor is provided on the image forming apparatus in a state in which the image heating device is detached therefrom.

To achieve the aforementioned object, an image copying machine according to the present invention includes an image reading apparatus that includes image reading means for reading an original image, and the first or second image forming apparatus that forms and thermally fixes a toner image according to the original image read by the image reading apparatus onto a recording medium.

To achieve the aforementioned object, a first temperature controlling method according to the present invention is applicable to an image heating device that includes: a movable heating member (belt) for directly heating the material to be heated (a recording sheet, an OHP film, etc.); heat-generating means for directly or indirectly heating the heating member; pressing means arranged in contact with the heating member; a temperature sensor for detecting a temperature of the heating member; controlling means for controlling an amount of heat generated by the heat-generating means according to the temperature detected by the temperature sensor so that the heating member has a set temperature; and a cover for enclosing a space occupied by at least a part of the heating member, the temperature sensor, and the pressing means excluding a path portion through which the material to be heated passes, so as to make the temperature of the heating member detected by the temperature sensor substantially coincide with an ambient temperature in the vicinity of the temperature sensor. The method includes the steps of: measuring at least one of the temperature of the heating member and a variation with time in the temperature of the heating member after the heating of the heating member by the heat-generating means is stopped, by using the temperature sensor; determining the set temperature for the heating member in a subsequent image heating period by estimating a temperature of the pressing means according to at least one of the temperature of the heating member and the variation with time in the temperature that are measured in the measuring step; and controlling an amount of heat generated by the heat-generating means by using the controlling means, so that the set temperature determined in the set temperature determining step is obtained.

With the foregoing configuration of the first temperature controlling method, it is possible to realize a temperature controlling method suitable for the first image heating device having a cover.

To achieve the aforementioned object, a second temperature control method is applicable to an image heating device that includes a movable heating member for directly heating the material to be heated;.heat-generating means for directly or indirectly heating the heating member; pressing means arranged in contact with the heating member; a temperature sensor for detecting a temperature of the heating member; controlling means for controlling an amount of heat generated by the heat-generating means according to the temperature detected by the temperature sensor so that the heating member has a set temperature; and a cover for enclosing a space occupied by at least a part of the heating member, the temperature sensor, and the pressing means excluding a path portion through which the material to be heated passes, so as to make the temperature of the heating member detected by the temperature sensor substantially coincide with an ambient temperature in the vicinity of the temperature sensor. The method includes the steps of: measuring at least one of the temperature of the heating member and a variation with time in the temperature of the heating member after the heating of the heating member by the heat-generating means is stopped, by using the temperature sensor; determining a preheating mode for the heating member in a stand-by period until a subsequent start of image heating, according to at least one of the detected temperature of the heating member and a variation with time in the detected temperature measured in the measuring step; and preheating the heating member according to the preheating mode determined in the preheating mode determining step.

With this configuration of the second temperature controlling method, it is possible to realize a temperature controlling method suitable for the second image heating device having a cover.

To achieve the aforementioned object of the present invention, a third temperature controlling method is applicable to an image forming apparatus that includes: image forming means for forming an unfixed toner image onto a recording medium as a material to be heated and having the unfixed image carried thereon; a removable image heating device for thermally fixing the toner image onto the recording medium, the image heating device including a movable heating member for directly heating the material to be heated; heat-generating means for directly or indirectly heating the heating member; pressing means arranged in contact with the heating member; a temperature sensor for detecting a temperature of the heating member; and controlling means for controlling an amount of heat generated by the heat-generating means according to the temperature detected by the temperature sensor so that the heating member has a set temperature; and a cover for enclosing a space occupied by at least a part of the heating member, the temperature sensor, and the pressing means excluding a path portion through which the material to be heated passes when the fixing device is attached, so as to make the temperature of the heating member detected by the temperature sensor substantially coincide with an ambient temperature in the vicinity of the temperature sensor. The method includes the steps of: measuring at least one of the temperature of the heating member and a variation with time in the temperature of the heating member after the heating of the heating member by the heat-generating means is stopped, by using the temperature sensor; determining the set temperature for the heating member in a subsequent image heating period by estimating a temperature of the pressing means according to at least one of the temperature of the heating member and the variation with time in the temperature that are measured in the measuring step; and controlling an amount of heat generated by the heat-generating means by using the controlling means, so that the set temperature determined in the set temperature determining step is obtained.

With the foregoing configuration of the third temperature controlling method, it is possible to realize a fixing temperature control suitable for an image forming apparatus that includes the removable first image heating device without a cover and a cover for the first image heating device.

To achieve the aforementioned object, a fourth temperature controlling method according to the present invention is applicable to an image forming apparatus includes: image forming means for forming an unfixed toner image onto a recording medium as a material to be heated and having the unfixed image carried thereon; a removable image heating device for thermally fixing the toner image onto the recording medium, the image heating device including: a movable heating member for directly heating the material to be heated; heat-generating means for directly or indirectly heating the heating member; pressing means arranged in contact with the heating member; a temperature sensor for detecting a temperature of the heating member; and controlling means for controlling an amount of heat generated by the heat-generating means according to the temperature detected by the temperature sensor so that the heating member has a set temperature; and a cover for enclosing a space occupied by at least a part of the heating member, the temperature sensor, and the pressing means excluding a path portion through which the material to be heated passes when the fixing device is attached, so as to make the temperature of the heating member detected by the temperature sensor substantially coincide with an ambient temperature in the vicinity of the temperature sensor. The method includes the steps of: measuring at least one of the temperature of the heating member and a variation with time in the temperature of the heating member after the heating of the heating member by the heat-generating means is stopped, by using the temperature sensor; determining a preheating mode for the heating member in a stand-by period until a subsequent start of image heating, according to at least one of the detected temperature of the heating member and the variation with time in the detected temperature measured in the measuring step; and preheating the heating member according to the preheating mode determined in the preheating mode determining step.

With the foregoing configuration of the fourth temperature controlling method, it is possible to provide a preheating control suitable for an image forming apparatus that includes the removable second image heating device without a cover and a cover for the second image heating device.

BRIEF DESCRIPTION OF THE DRAWINGS

FIG. 5A illustrates an example of contents on a look-up table for low temperature (Table A).

FIG. 5B illustrates an example of contents on a look-up table for intermediate temperature (Table B).

FIG. 5C illustrates an example of contents on a look-up table for high temperature (Table C).

FIG. 7 illustrates specific values of a peak value P0 of an applied electric power, an upper limit temperature Th, and a lower limit temperature Tl corresponding to environmental conditions (NN environment, LL environment) in each preheating mode (Modes 1 to 4) selected according to the cooling time tp necessary for cooling from 150° C. to 120° C. in the flowchart shown in FIG. 6.

DETAILED DESCRIPTION OF THE INVENTION

Figure 1:
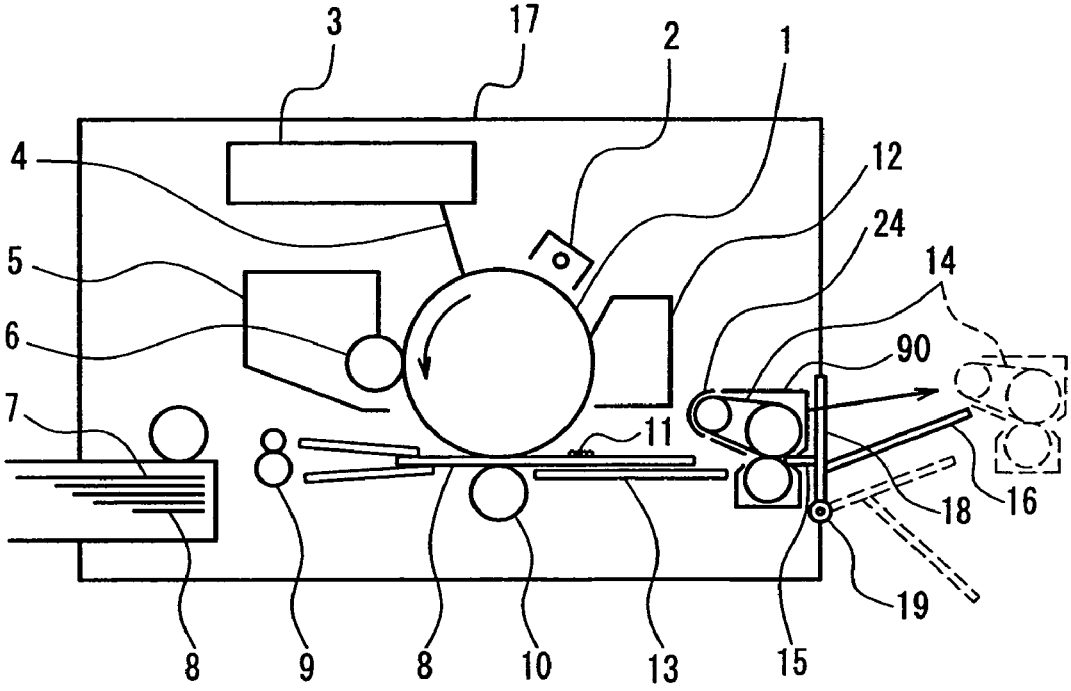
FIG. 1 is a schematic cross-sectional view showing an overall configuration of an image forming apparatus using as a fixing device an image heating device according to a first embodiment of the present invention.

Hereinafter, preferable embodiments of the present invention will be described specifically with reference to the accompanying drawings. In the drawings, the same or corresponding components are referred to with the same numerals, and the explanations thereof will not be repeated.

FIRST EMBODIMENT

FIG. 1 is a schematic cross-sectional view showing an overall configuration of an image forming apparatus using as a fixing device an image heating device according to a first embodiment of the present invention. The configuration and operation of this apparatus will be described in the following.

In FIG. 1, numeral 17 denotes an outer shell for the main body of the image forming apparatus, and numeral 1 denotes an electrophotographic photoreceptor (hereinafter referred to as "photosensitive drum"). While this photosensitive drum 1 is driven rotationally at a predetermined peripheral speed in the arrow direction, its surface is charged homogeneously to a predetermined negative dark potential V0 by a charger 2.

Numeral 3 denotes a laser beam scanner, which outputs a laser beam 4 that is modulated in accordance with a time-series electric digital image signal of image information that is input from a host device (not shown in the drawing) such as an image reading apparatus or a computer. The surface of the photosensitive drum 1, which has been charged homogeneously as described above, is scanned and exposed by the laser beam 4, and the absolute potential of the exposed portion of the photosensitive drum 1 is decreased to the light potential VL. Thus, an electrostatic latent image is formed on the surface of the photosensitive drum 1. This electrostatic latent image is then reversely developed with negatively charged toner in a developing device 5 and made manifest.

The developing device 5 includes a developing roller 6, which is driven rotationally. The developing roller 6 is arranged in opposition to the photosensitive drum 1, and a thin layer of toner is formed on an outer peripheral surface of the developing roller 6. A developing bias voltage, whose absolute value is lower than the dark potential V0 and higher than the light potential VL of the photoelectric drum 1, is applied to the developing roller 6. The toner on the developing roller 6 is thus transferred only to the portion of the photosensitive drum 1 with the light potential VL, whereby the electrostatic latent image is made manifest to form a toner image 11.

On the other hand, a recording sheet 8 is fed one by one from a paper-feed portion 7 to a nip portion formed between the photosensitive drum 1 and a transfer roller 10 via a resist roller pair 9 with suitable timing in synchronization with the rotation of the photosensitive drum 1. Then, the toner image 11 on the photosensitive drum 1 is transferred to the recording sheet 8 by the transfer roller 10 to which a transfer bias is applied.

Numeral 13 denotes a paper guide for fixing, which guides the recording sheet 8 onto which the toner image 11 has been transferred to a fixing device 14. After the recording sheet 8 carrying the transferred toner image 11 has separated from the photosensitive drum 1, it is fed into the fixing device 14, which fixes the transferred toner image 11 onto the recording sheet 8. Numeral 15 denotes a paper eject guide, which guides the recording sheet 8 that has passed through the fixing device 14 to the outside of the image forming apparatus. The recording sheet 8 onto which the toner image 11 has been fixed is then ejected to a paper eject tray 16. Numeral 18 denotes a fixing door for allowing attachment/detachment of the fixing device 14 and elimination of a paper jam. The fixing door 18 is opened and closed together with the paper eject tray 16 while rotating about a hinge 19. By opening the fixing door 18, it becomes possible to attach/detach the fixing device 14 to/from the image forming apparatus main body in the direction perpendicular to the axis of a heat-generating roller 21 (see FIG. 2). In FIG. 1, the fixing device 14 shown by the dashed line illustrates its position when it is detached from the image forming apparatus main body, whereas the fixing device 14 shown by the solid line illustrates its position when it is attached to the image forming apparatus main body. As shown in FIG. 1, only the fixing device 14 is attached/detached to/from the image forming apparatus main body while leaving magnetization means 24 such as a magnetization coil 25 (see FIG. 2) described later in the image forming apparatus main body.

After the recording sheet 8 has separated from the photosensitive drum 1, the surface of the photosensitive drum 1 is cleaned with a cleaning device 12. The cleaning device 12 removes residual material such as remaining toner so that the photosensitive drum 1 can be used repeatedly for subsequent image formation.

Figure 13:
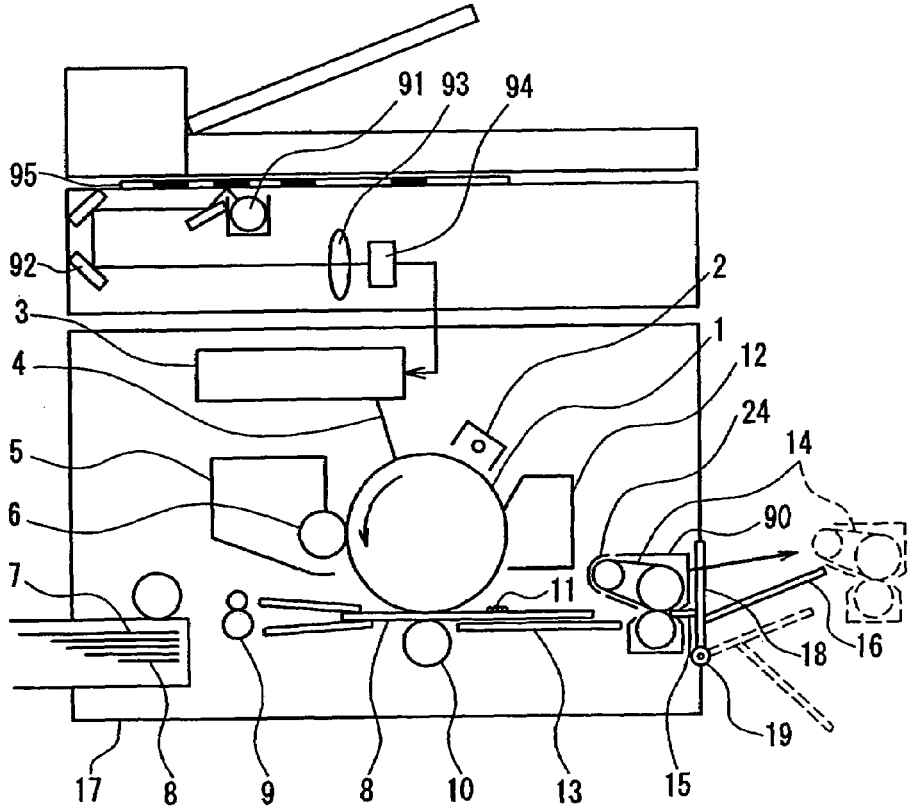
FIG. 13 is a cross-sectional view showing an overall configuration of an image copying machine using the image forming apparatus shown in FIG. 1.

FIG. 13 is a schematic cross-sectional view showing an overall configuration of an image copying machine using the image forming apparatus shown in FIG. 1. In FIG. 13, numeral 91 denotes a light source for exposing an original document 95. Light reflected from a non-image portion of the original document 95 is reflected by a mirror 92 and focused by a lens 93. The image information read by a photoelectric transducer 94 such as CCD then is converted into a time-series electric digital image signal by an A/D converter (not shown in the drawing), for example. After that, the image information is input to the laser beam scanner 3 provided in the image forming apparatus and is used for image formation.

Hereinafter, an image heating device according to the present embodiment will be described more specifically by way of specific examples.

Figure 2:
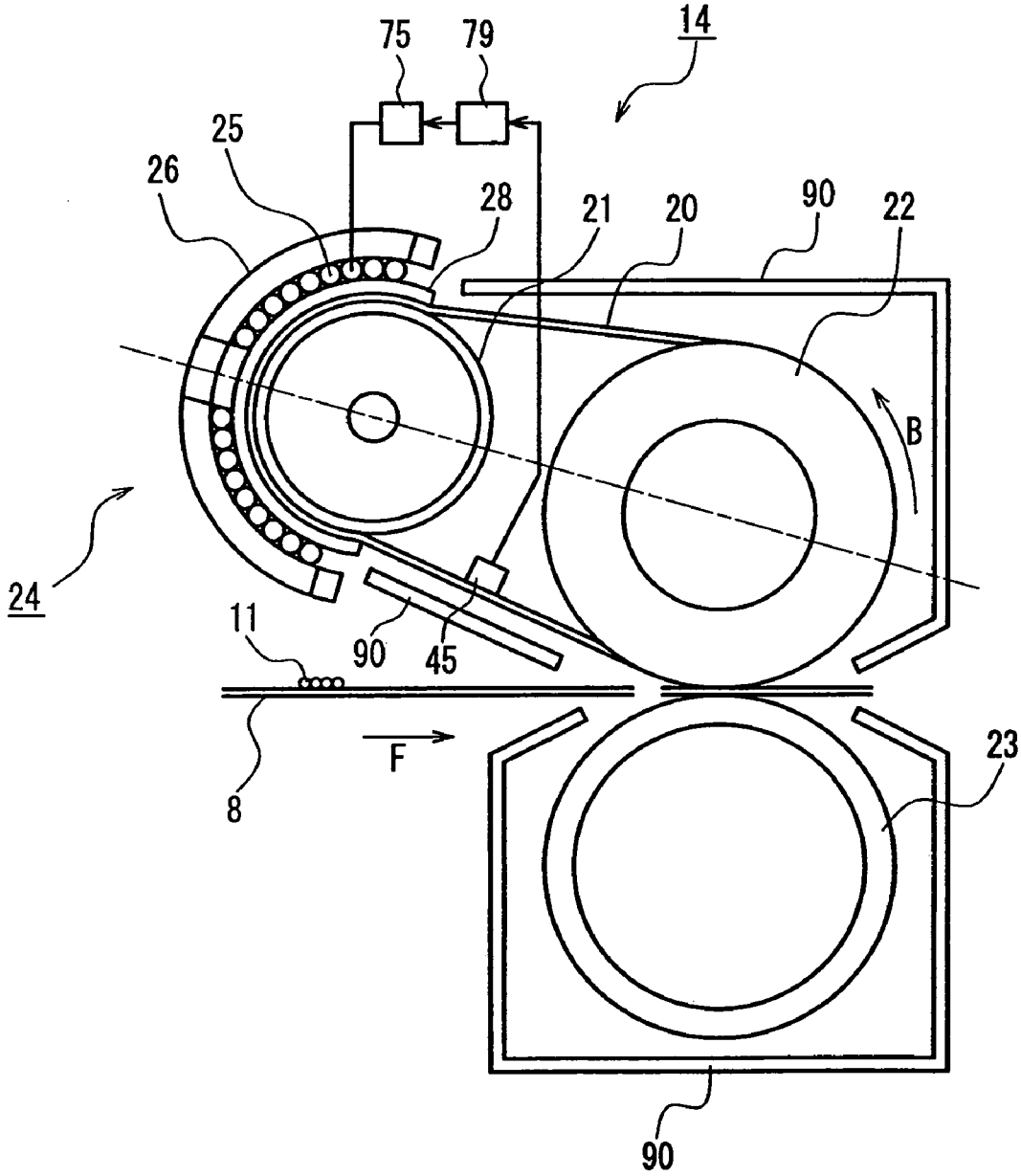
FIG. 2 is a cross-sectional view showing a configuration of the image heating device according to the first embodiment of the present invention.

FIG. 2 is a cross-sectional view showing a fixing device as an image heating device used in the above-described image forming apparatus.

In FIG. 2, numeral 25 denotes a magnetization coil as a part of magnetization means 24. This magnetization coil 25 may be formed using a litz wire of bundled thin wires. The magnetization coil 25 has a cross section in the shape covering a fixing belt 20 looped around the heat-generating roller 21. A core 26 made of ferrite is provided in the center of the magnetization coil 25 as well as in a portion of the rear surface of the magnetization coil 25. For the core 26, a material with high magnetic permeability such as permalloy also can be used in addition to ferrite. The magnetization coil 25 is provided outside the heat-generating roller 21. A magnetizing current of, for example, 23 kHz is applied to the magnetization coil 25 from an exciting circuit 75. Thus, the heat-generating roller 21 partially is heated through electromagnetic induction.

Although the magnetization coil 25 shown in FIG. 2 is provided outside the heat-generating roller 21, the magnetization coil may be provided inside the heat-generating roller.

A temperature sensor 45 is provided so as to be in contact with the rear surface of the fixing belt 20 at the portion past the contact portion in which the fixing belt 20 and the heat-generating roller 21 are in contact with each other. The temperature of the fixing belt 20 thus can be detected by the temperature sensor 45.

Numeral 79 denotes controlling means. The controlling means 79 controls the amount of the heat generated by the heat-generating roller 21 by controlling the electric power to be supplied to the magnetization coil 25 via the exciting circuit 75 on the basis of the temperature of the fixing belt detected by the temperature sensor 45 and a variation with time in the detected temperature so that an optimal fixing temperature is obtained. This controlling method will be described later in detail.

Numeral 28 denotes a coil guide as a supporting member. This coil guide 28 is made of a resin with a superior heat resistance, such as PEEK material or PPS, and is formed in one piece with the magnetization coil 25 and the core 26. The coil guide 28 provided in this manner can prevent the magnetization coil 25 from being damaged due to the heat generated by the heat-generating roller 21 and remaining in the space between the heat-generating roller 21 and the magnetization coil 25.

Although the core 26 shown in FIG. 2 has a semicircular cross section, it is not necessary to form the core 26 in a shape along the magnetization coil 25. For example, the core 26 may have a cross section substantially in the shape of the letter Π (Greek letter "pi" in uppercase).

The thin fixing belt 20 may be an endless belt of 50 mm diameter and 90 μm thickness, which includes a polyimide resin with a glass transition point of 360° C. as a base. To impart lubrication to the fixing belt 20, the surface of the belt is coated with a lubricant layer (not shown in the drawing) made of a fluorocarbon resin of 30 μm thickness. For the base, in addition to the polyimide resin used in the present example, other resins with a heat resistance, such as a fluorocarbon resin, also can be used. Preferably, the base of the fixing belt 20 has a glass transition point of 200° C. to 500° C. For the lubricant layer on the surface of the fixing belt 20, a resin or rubber with good lubrication, such as PTFE, PFA, FEP, silicone rubber, or fluorocarbon rubber, may be used alone or in combination. If the fixing belt 20 is used to fix monochrome images, only lubrication has to be ensured. However, if the fixing belt 20 is used to fix color images, it is preferable that the fixing belt 20 has elasticity. In this case, it is necessary to form a thicker rubber layer. The fixing belt 20 preferably has a thermal capacity of not more than 60 J/K, more preferably not more than 40 J/K.

The fixing belt 20 is suspended with a predetermined tensile force between the heat-generating roller 21 and a fixing roller 22 of 20 mm diameter with low thermal conductivity, whose surface may be made of elastic foamed silicone rubber with low hardness (JIS A30 degrees), and is rotationally movable in arrow direction B.

The heat-generating roller 21 may be made of SUS 430 in a cylindrical shape, which is 30 mm in diameter, 320 mm in length, and 0.5 mm in thickness. The thermal capacity of the heat-generating roller 21 is 54 J/K. For the heat-generating roller 21, other than SUS 430, another magnetic material such as iron also can be used. The thermal capacity of the heat-generating roller 21 preferably is 60 J/K or less, more preferably 40 J/K or less.

The pressure roller 23 may be made of silicone rubber with a hardness of JIS A65 degrees and pressed against the fixing roller 22 via the fixing belt 20, thereby forming a nip portion. In this state, the pressure roller 23 is supported so as to rotate following the fixing roller 22. For the pressure roller 23, a heat-resistant resin or rubber, such as fluorocarbon rubber other than the silicone rubber or a fluorocarbon resin, also may be used. To enhance abrasion resistance and lubrication of the pressure roller 23, it is preferable that the surface of the pressure roller 23 is coated with a resin such as PFA, PTFE, or FEP or rubber alone or in combination. Further, to avoid heat radiation, it is preferable that the pressure roller 23 is made of a material with low thermal conductivity.

The pressure roller 23 is driven rotationally by a driving source (not shown in the drawing) provided in the main body of the image forming apparatus. The fixing roller 22 rotates following the pressure roller 23 via the fixing belt 20. Then, the heat-generating roller 21 rotates following the fixing roller 22 via the fixing belt 20.

Numeral 90 denotes a cover enclosing the space occupied by the fixing belt 20, the heat-generating roller 21, the fixing roller 22, the temperature sensor 45, and the pressure roller 23. The cover 90 serves to make the temperature of the fixing belt 20 coincide with the temperature of the atmosphere surrounding the fixing belt 20, thus preventing the temperature of the pressure roller 23 from becoming higher than that of the fixing belt 20. As a result, it becomes possible to estimate the temperature of the pressure roller 23 accurately.

In the fixing device shown in FIG. 2, the fixing belt 20 is suspended between the heat-generating roller 21 and a fixing roller 22. However, the fixing device may have a single-shaft structure in which a tube-like fixing belt is provided on a fixing roller. In this case, the fixing belt also is driven by a pressure roller. The fixing device may be constructed in such a manner that only the tube-like fixing belt is rotated with the fixing roller or a fixing and pressing member being fixed, or the fixing roller and the fixing belt may be rotated at the same time. In this case, a magnetization coil may be provided either outside or inside the loop of the fixing belt.

Figure 10:
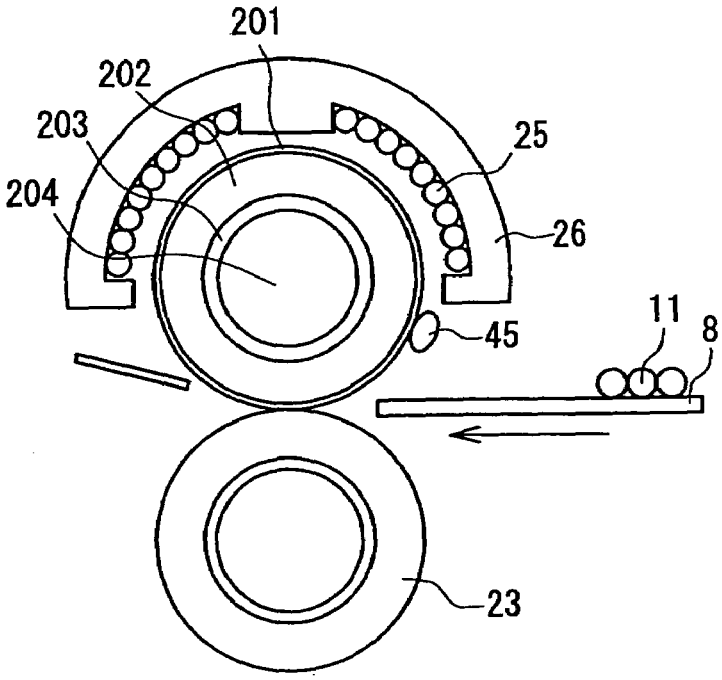
FIG. 10 is a cross-sectional view showing another example of a configuration of the fixing device shown in FIG. 2.
Figure 11:
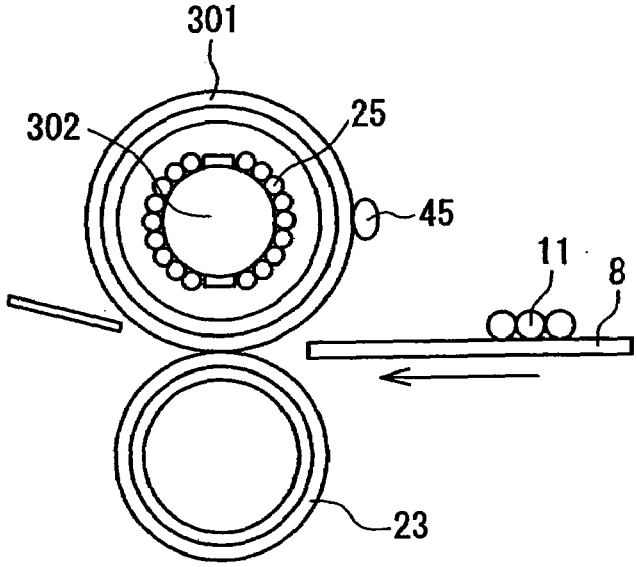
FIG. 11 is a cross-sectional view showing still another example of a configuration of the fixing device shown in FIG. 2.
Figure 12:
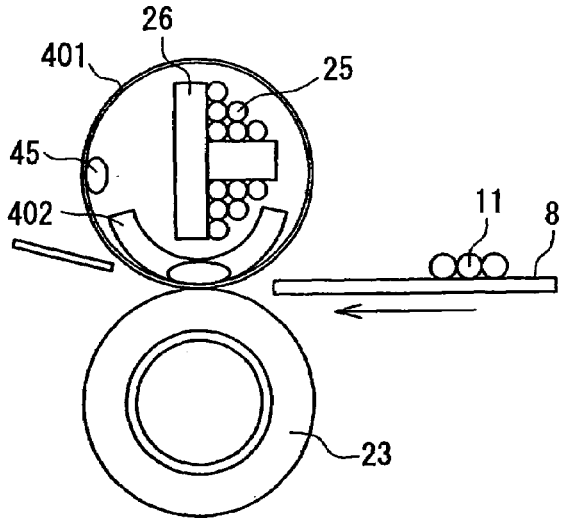
FIG. 12 is a cross-sectional view showing still another example of a configuration of the fixing device shown in FIG. 2.

FIGS. 10, 11, and 12 show an example of a fixing device with a single-shaft structure. In FIGS. 10 to 12, the components having the same configuration and performing the same function as those in FIG. 2 are referred to with the same numerals.

FIG. 10 is a cross-sectional view showing one example of a configuration of a single-shaft fixing device of an outside-coil type.

In FIG. 10, a fixing roller may include a core shaft 204, a magnetic shielding layer 203 formed on the core shaft 204, and a silicone rubber layer 202 made of elastic foamed silicone rubber with low hardness (Asker-C 40 degrees) formed on the magnetic shielding layer 203, and a fixing belt 201 made of metal is provided on the outer surface of the silicone rubber layer 202. The metal fixing belt 201 has the same configuration as that of the fixing belt 20, except that the base of the fixing belt 201 is made of a very thin metal such as nickel fabricated by electroforming.

According to this configuration, an apparent thermal capacity is smaller than that of a fixing device with a dual-shaft structure, and the time required for raising the temperature thus can be shortened. However, since the fixing device is more susceptible to the influence of the temperature of the pressure roller, temperature control according to the present invention is necessary.

FIG. 11 is a cross-sectional view showing another example of a configuration of a single-shaft fixing device of an inside-coil type.

In FIG. 11, a fixing roller 301 may be made of SUS 430 in a cylindrical shape, which is 30 mm in diameter, 320 mm in length, and 0.8 mm in thickness. For the fixing roller 301, other than SUS 430, another magnetic material such as iron also can be used. A magnetization coil 25 is wound around a coil holder 302 made of a heat-resistant resin and heats the fixing roller 301 from the inside of the fixing roller 301.

FIG. 12 is a cross-sectional view showing still another example of a configuration of a single-shaft fixing device of an inside-coil type.

In FIG. 12, a fixing belt 401 is a belt whose base is made of a very thin metal such as nickel fabricated by electroforming. The fixing belt 401 has a lubricant layer formed on its surface via an elastic silicone rubber layer. For the lubricant layer, a resin or rubber with good lubrication, such as PTFE, PFA, FEP, silicone rubber, or fluorocarbon rubber, may be used alone or in combination.

The fixing belt 401 is held between a pressing member 402 and a pressure roller 23, and rotates following the pressure roller 23.

According to this configuration, since the fixing belt 401 has a small thermal capacity, the fixing belt 401 is susceptible to the influence of an ambient temperature and fixing properties thereof are dependent highly on the temperature of the pressure roller. Accordingly, temperature control according to the present invention can provide a noticeable improvement.

By inserting the recording sheet 8, onto which the toner image 11 has been transferred using the image forming apparatus of FIG. 1, into the fixing device having the above-described configuration in arrow direction F with the side carrying the toner image 11 facing the fixing roller 22 as shown in FIG. 2, the toner image 11 can be fixed on the recording sheet 8.

Figure 3:
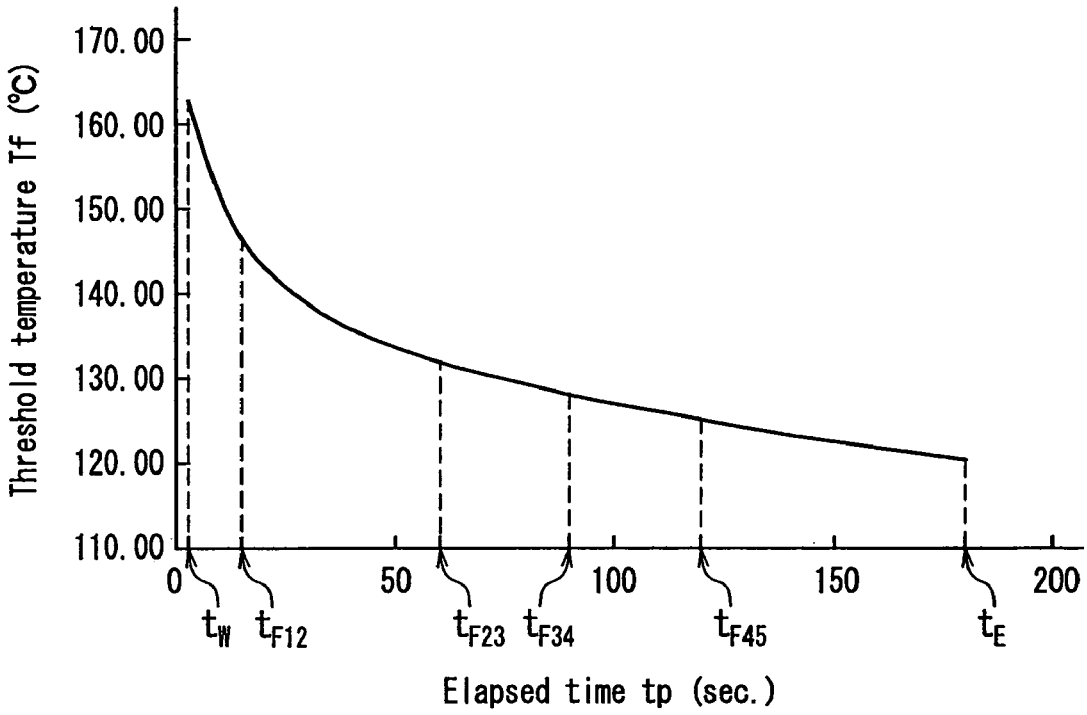
FIG. 3 shows a cooling curve of a threshold temperature Tf of the fixing belt 20 in the first embodiment that varies with an elapsed time tp from the completion of printing.

FIG. 3 is a view showing a cooling curve of a threshold temperature Tf of the fixing belt 20 in the present embodiment that varies with an elapsed time tp from the completion of printing. As will be mentioned later with reference to a flowchart of FIG. 4, the cooling curve is used for, in response to a print request given from a user, selecting one of a plurality of look-up tables storing various fixing temperatures, depending on the relationship between a temperature Tb (actually measured value) of the fixing belt 20 that is detected by the temperature sensor 45 and the threshold temperature Tf (reference value) at an elapsed time tp in a time range from the completion of the previous printing operation to immediately before the start of the next printing operation, so as to control the fixing temperature optimally.

In FIG. 3, during a period from the completion of the printing (tp=0) until tp=$t_W$ (for instance, $t_W$=two seconds), with use of a thermistor as the temperature sensor 45, for instance, a difference between the detected temperature Tb of the fixing belt 20 and the threshold temperature Tf is smaller than a resolution of the thermistor. Hence it is impossible to determine the relationship between the detected temperature Tb and the threshold temperature Tf accurately. Therefore, the fixing temperature controlling operation is not carried out, remaining in a stand-by state.

The threshold temperature Tf during a period from the time $t_W$ ($t_W$=two seconds) to a time $t_{F12}$ (for instance, $t_{F12}$=15 seconds) is given as the following formula F1 in which the elapsed time tp is a parameter:

$$Tf=0.00002tp^4-0.0024tp^3+0.1017tp^2-2.5119tp+167.68 \quad \text{(F1)}$$

The threshold temperature Tf during a period from the time $t_{F12}$ ($t_{F12}$=15 seconds) to a time $t_{F23}$ (for instance, $t_{F23}$=60 seconds) is given as the following formula F2 in which the elapsed time tp is a parameter:

$$Tf=0.0000025tp^4-0.0005tp^3+0.03901tp^2-1.5906tp+162.53 \quad \text{(F2)}$$

The threshold temperature Tf during a period from the time $t_{F23}$ ($t_{F23}$=60 seconds) to a time $t_{F34}$ (for instance, $t_{F34}$=90 seconds) is given as the following formula F3 in which the elapsed time tp is a parameter:

$$Tf=-0.1313tp+139.81 \quad \text{(F3)}$$

The threshold temperature Tf during a period from the time $t_{F34}$ ($t_{F34}$=90 seconds) to a time $t_{F45}$ (for instance, $t_{F45}$=120 seconds) is given as the following formula F4 in which the elapsed time tp is a parameter:

$$Tf=31\ 0.1tp+136.99 \quad \text{(F4)}$$

The threshold temperature Tf during a period from the time $t_{F45}$ ($t_{F45}$=120 seconds) to a time $t_E$ (for instance, $t_E$=180 seconds) is given as the following formula F5 in which the elapsed time tp is a parameter:

$$Tf=-0.0831tp+134.96 \quad \text{(F5)}$$

It should be noted that after the time $t_E$ ($t_E$=180 seconds), one of the look-up tables is selected simply according to only the temperature Tb of the fixing belt 20, without using the threshold temperature Tf. This is because, when 180 seconds (t1) elapse from the completion of the previous image heating operation, the temperature Tb of the fixing belt 20 has lowered sufficiently. Hence, the temperature of the pressure roller 23 is assumed to have lowered sufficiently. This applies to the case where the temperature Tb of the fixing belt 20 lowers to 120° C. or below.

Hereinafter, a method for controlling a fixing temperature using the above-described configuration of the image heating device and the above-described cooling curve of the fixing belt 20 will be mentioned with reference to FIGS. 4 and 5A to 5C, as well as FIGS. 2 and 3.

Figure 4:
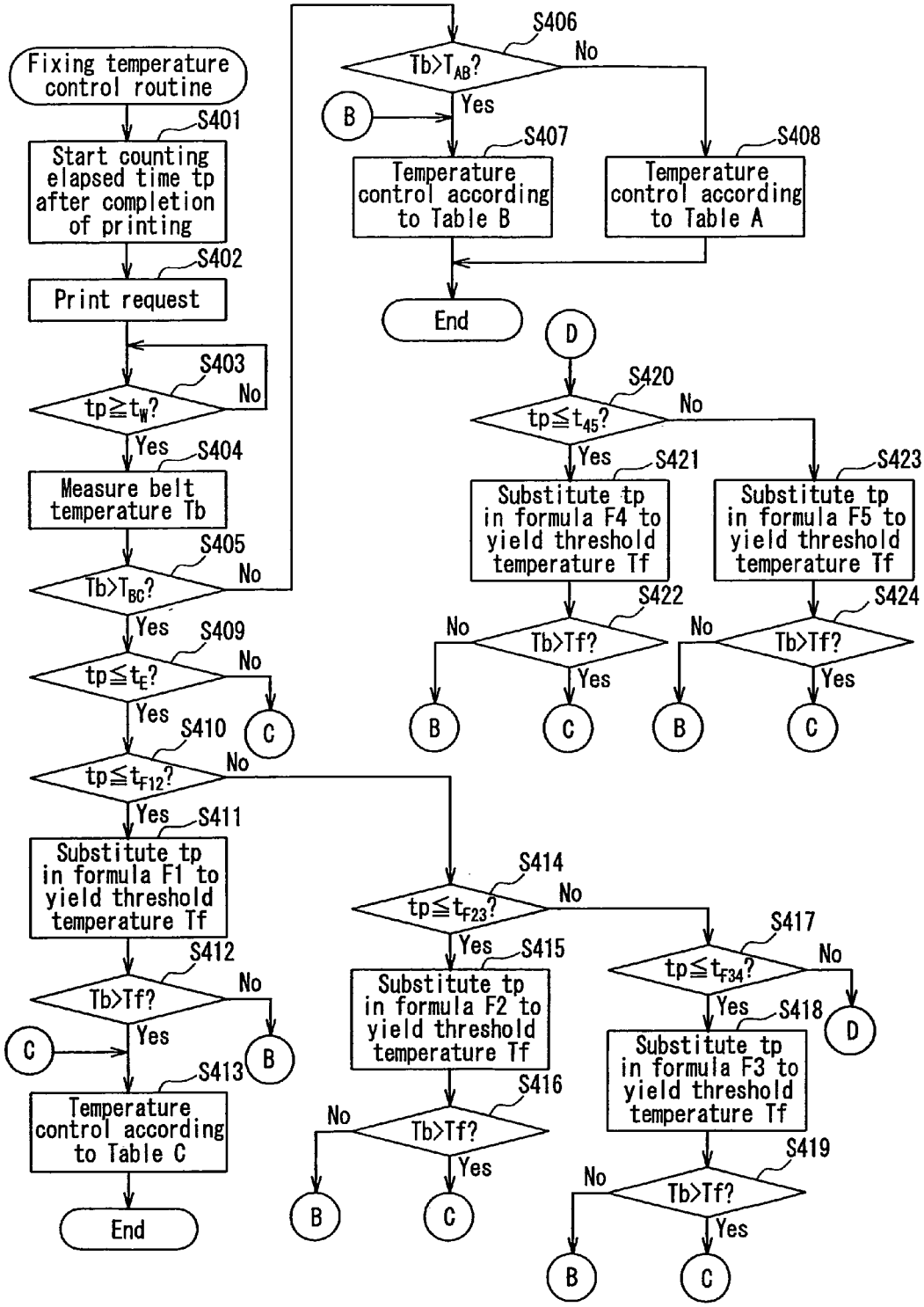
FIG. 4 is a flowchart illustrating a flow of a process for a fixing temperature control routine applied to an image heating device and an image forming apparatus according to the first embodiment.

FIG. 4 is a flowchart illustrating a flow of a process for a fixing temperature control routine applied to an image heating device and an image forming apparatus according to the present embodiment.

FIG. 5A illustrates an example of contents on a look-up table for low temperature (Table A), FIG. 5B illustrates an example of contents on a look-up table for intermediate temperature (Table B), and FIG. 5C illustrates an example of contents on a look-up table for high temperature (Table C).

In FIG. 4, first of all, upon completion of printing (tp=0), the count of elapsed time tp by a timer (not shown) is started (S401). In response to a print request issued by the user (S402) after the completion of printing, after awaiting the elapsed time tp reaching or exceeding $T_W$ (=2 seconds) (S403), the temperature sensor 45 detects the temperature Tb of the fixing belt 20 and measures the same (S404).

Next, it is determined whether or not the temperature Tb of the fixing belt 20 (hereinafter referred to as belt temperature Tb) exceeds a temperature $T_{BC}$ (=120° C.) as a reference for selecting either Table B for intermediate temperature shown in FIG. 5B or Table C for high temperature shown in FIG. 5C (S405). In the case where it is determined in Step S405 that the belt temperature Tb does not exceed 120° C. (No), the flow branches to Step S406, where it is determined whether or not the belt temperature Tb exceeds a temperature $T_{AB}$ (=70° C.) as a reference for selecting either Table A for low temperature shown in FIG. 5A and Table B for intermediate temperature shown in FIG. 5B. In the case where it is determined in Step S406 that the belt temperature Tb exceeds 70° C. (Yes), Table B is selected, and the fixing temperature is controlled according to a set temperature stored in Table B (160° C. or 167° C.) ("Temperature control according to Table B": S407). In contrast, in the case where it is determined in Step S406 that the belt temperature Tb is not higher than 70° C. (No), Table A is selected, and the fixing temperature is controlled according to a set temperature (165° C. or 170° C.) stored in Table A, which is higher than a set temperature of Table B ("Temperature control according to Table A": S408).

On the other hand, in the case where it is determined in Step S405 that the belt temperature Tb exceeds 120° C. (Yes), the flow goes to Step S409, where it is determined whether the elapsed time tp counted by the timer is not more than $t_E$ (=180 seconds). In the case where it is determined in Step 409 that the elapsed time tp exceeds 180 seconds (No), the flow goes to Step S413, where Table C is selected, and the fixing temperature is controlled according to a set temperature (155° C. or 163° C.) lower than that in Table B (temperature control according to Table C).

On the other hand, in the case where it is determined in Step 409 that the elapsed time tp is within 180 seconds (Yes), the flow goes to Step 410, where it is determined whether or not the elapsed time tp is within the time $t_{F12}$ (=15 seconds) (however, not less than 2 seconds) as a reference for selecting either the aforementioned formula F1 or formula F2. In the case where it is determined in Step 410 that the elapsed time tp is within 15 seconds (Yes), the elapsed time tp until immediately before the start of printing is substituted in the formula F1, so that a threshold temperature Tf is yielded (S411).

Next, it is determined whether the belt temperature Tb exceeds the threshold temperature Tf yielded in Step 411 (S412), and in the case where the belt temperature Tb does not exceed the threshold temperature Tf (No), the flow branches to Step S407, where the temperature control is carried out according to Table B for intermediate temperature. On the other hand, in the case where it is determined in Step 412 that the belt temperature Tb exceeds the threshold temperature Tf (Yes), the flow goes to Step S413, where the temperature control is carried out according to Table C for high temperature.

On the other hand, in the case were it is determined in Step 410 that the elapsed time tp exceeds 15 seconds (No), the flow branches to Step S414, where it is determined whether the elapsed time tp is within the time $t_{F23}$ (=60 seconds) as a reference for selecting either the above-described formula F2 or formula F3. In the case where it is determined in Step S414 that the elapsed time tp is within 60 seconds (Yes), the elapsed time tp until immediately before the start of printing is substituted into the formula F2, so that a threshold temperature Tf is yielded (S415).

Next, it is determined whether or not the belt temperature Tb exceeds the threshold temperature Tf yielded at Step 415 (S416), and in the case where the belt temperature Tb does not exceed the threshold temperature Tf (No), the flow branches to Step S407, where the temperature control is carried out according to Table B for intermediate temperature. On the other hand, in the case where it is determined in Step 416 that the belt temperature Tb exceeds the threshold temperature Tf (Yes), the flow goes to Step S413, where the temperature control is carried out according to Table C for high temperature.

On the other hand, in the case where it is determined in Step 414 that the elapsed time tp exceeds 60 seconds (No), the flow branches to Step 417, where it is determined whether the elapsed time tp is within a time $T_{F34}$ (=90 seconds) as a reference for selecting either the above-described formula F3 or formula F4. In the case where it is determined in Step S417 that the elapsed time tp is within 90 seconds (Yes), the elapsed time tp until immediately before the start of printing is substituted in the formula F3, so that a threshold temperature Tf is yielded (S418).

Next, it is determined whether or not the belt temperature Tb exceeds the threshold temperature Tf yielded at Step 418 (S419), and in the case where the belt temperature Tb does not exceed the threshold temperature Tf (No), the flow branches to Step S407, where the temperature control is carried out according to Table B for intermediate temperature. On the other hand, in the case where it is determined in Step 419 that the belt temperature Tb exceeds the threshold temperature Tf (Yes), the flow goes to Step S413, where the temperature control is carried out according to Table C for high temperature.

On the other hand, in the case where it is determined in Step S417 that the elapsed time tp exceeds 90 seconds (No), the flow branches to Step 420, where it is determined whether the elapsed time tp is within the time $t_{F45}$ (=120 seconds) as a reference for selecting either the above-described formula F4 or formula F5. In the case where it is determined in Step 420 that the elapsed time tp is within 120 seconds (Yes), the elapsed time tp until immediately before the start of printing is substituted in the formula F4, so that a threshold temperature Tf is yielded (S421).

Next, it is determined whether the belt temperature Th exceeds the threshold temperature Tf yielded at Step 421 (S422), and in the case where the belt temperature Tb does not exceed the threshold temperature Tf (No), the flow branches to Step S407, where the temperature control is carried out according to Table B for intermediate temperature. On the other hand, in the case where it is determined in Step 422 that the belt temperature Tb exceeds the threshold temperature Tf (Yes), the flow goes to Step S413, where the temperature control is carried out according to Table C for high temperature.

On the other hand, in the case where it is determined in Step S420 that the elapsed time tp exceeds 120 seconds (No), the elapsed time tp until immediately before the start of printing is substituted in the formula F5, so that a threshold temperature Tf is yielded (S423).

Next, it is determined whether the belt temperature Tb exceeds the threshold temperature Tf yielded at Step 423 (S424), and in the case where the belt temperature Tb does not exceed the threshold temperature Tf (No), the flow branches to Step S407, where the temperature control is carried out according to Table B for intermediate temperature. On the other hand, in the case where it is determined in Step 422 that the belt temperature Tb exceeds the threshold temperature Tf (Yes), the flow goes to Step S413, where the temperature control is carried out according to Table C for high temperature.

The foregoing fixing temperature control allows a temperature of the pressure roller 23 to be estimated according to the temperature of the fixing belt 20 and a variation in the temperature, thereby making it possible to set an optimal fixing temperature for a subsequent image heating operation, without providing a temperature sensor for detecting the temperature of the pressure roller 23. By so doing, it is possible to reduce the costs, to prevent fixed images from having irregularity in gloss caused by variations in the temperature of the pressure roller 23, and to prevent the fixing belt 20 from wrapping at a high temperature.

SECOND EMBODIMENT

An image heating device of the second embodiment of the present invention has the same configuration as that of the first embodiment shown in FIG. 2, except that preheating control for maintaining the temperature of the fixing belt 20 to approximately 100° C. is carried out during a stand-by period from the completion of the previous printing operation in the present embodiment, as compared with the first embodiment in which the fixing temperature control is carried out using the cooling curve of the fixing belt 20.

A method for controlling a preheating temperature will be mentioned below with reference to FIGS. 6, 7, 8A, and 8B.

Figure 6:
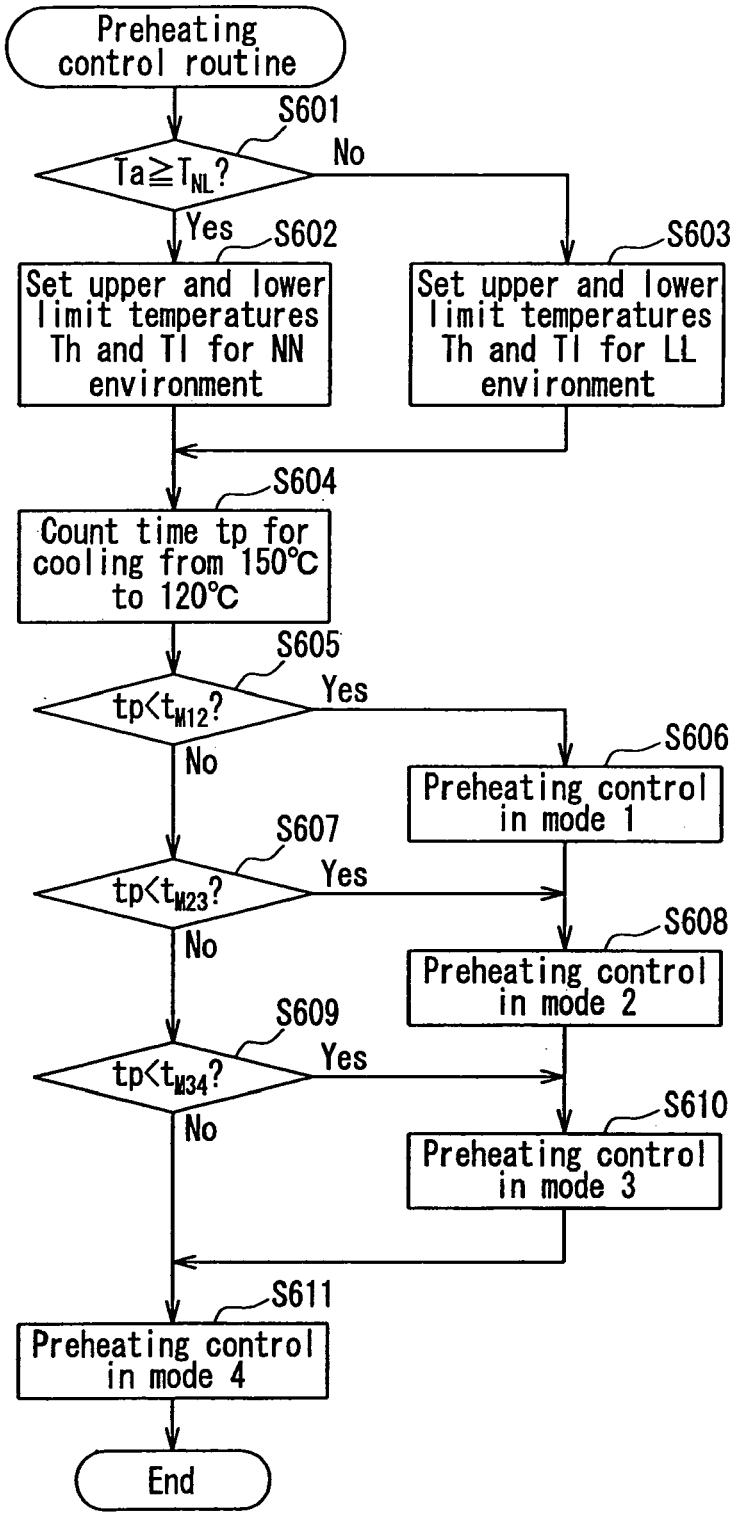
FIG. 6 is a flowchart illustrating a flow of a process for a preheating control routine applied to an image heating device and an image forming apparatus according to a second embodiment.

FIG. 6 is a flowchart illustrating a flow of a process for a preheating control routine applied to an image heating device and an image forming apparatus according to the present embodiment.

FIG. 7 illustrates specific values of a peak value P0 of an applied electric power, an upper limit temperature Th, and a lower limit temperature Tl corresponding to environmental conditions (NN environment, LL environment) in each preheating mode (Modes 1 to 4) selected according to the cooling time tp necessary for cooling from 150° C. to 120° C. in the flow shown in FIG. 6.

Figure 8A:
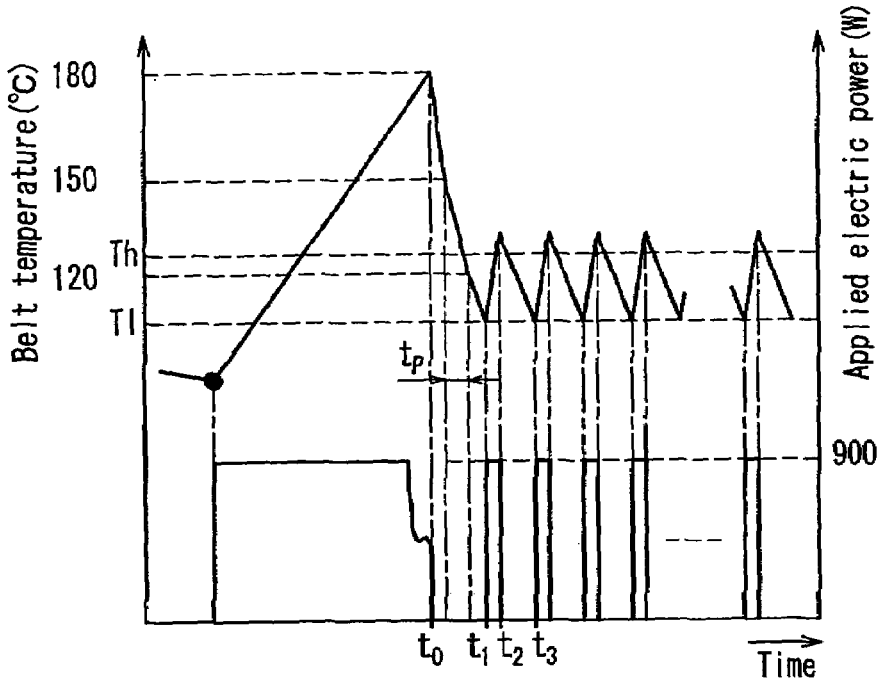
FIG. 8A is a waveform chart of the belt temperature and the applied electric power in the case where the preheating temperature control in Mode 1 of FIG. 7 is carried out.
Figure 8B:
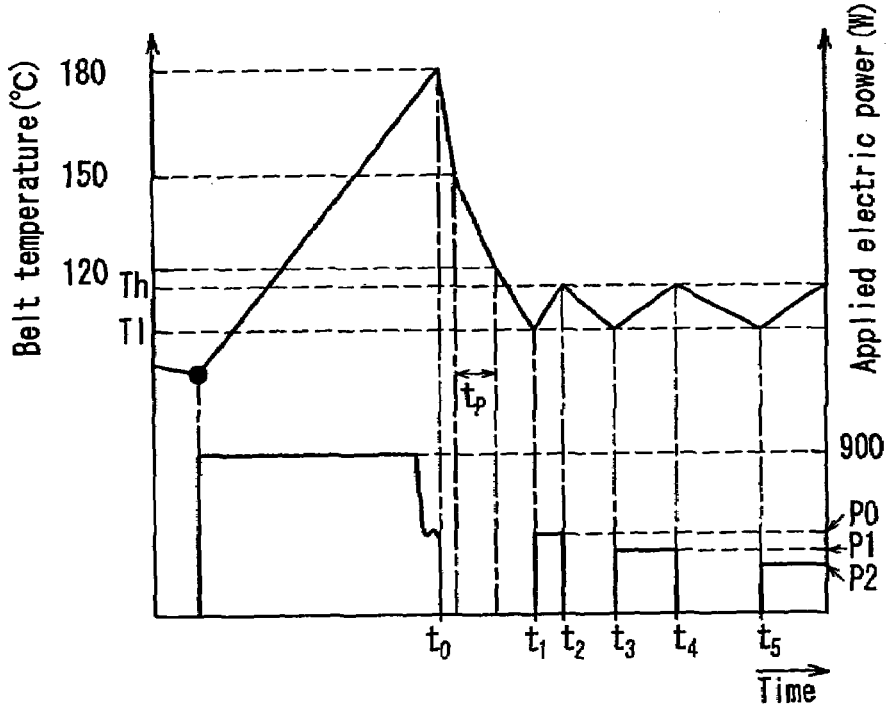
FIG. 8B is a waveform chart of the belt temperature and the applied electric power in the case where the preheating temperature controls in Mode 2 and Mode 3 shown in FIG. 7 are carried out.

FIG. 8A is a waveform chart of the belt temperature and the applied electric power in the case where the preheating temperature control in Mode 1 of FIG. 7 is carried out, and FIG. 8B is a waveform chart of the belt temperature and the applied electric power in the case where the preheating temperature control in Mode 2 and Mode 3 shown in FIG. 7 are carried out.

Upon the completion of the printing, the flow enters a preheating control routine shown in FIG. 6, and it is determined whether or not an environment temperature Ta is equal to or above a temperature $T_{NL}$ (=15° C.) as a reference for selecting either the NN environment or the LL environment (S601). In the case where it is determined in Step S601 that the environment temperature Ta is equal to or above $T_{NL}$ (Yes), the upper temperature Th and the lower temperature Tl for the NN environment shown in FIG. 7 are set (S602). On the other hand, in the case where it is determined in Step S601 that the environment temperature Ta is lower than $T_{NL}$ (No), the upper temperature Th and the lower temperature Tl for the LL environment shown in FIG. 7 are set (S603).

Next, a cooling time tp necessary for cooling the fixing belt 20 from 150° C. to 120° C. is counted (S604), and it is determined whether the cooling time tp thus counted is less than a cooling time $t_{M12}$ (for example, 10 seconds) as a reference for selecting either Mode 1 or Mode 2 (S605). In the case where it is determined in Step S605 that the cooling time tp is less than 10 seconds (Yes), preheating control according to Mode 1 is carried out (S606).

As shown in FIG. 8A, in the case where the cooling time tp from a time t0 at which the temperature of the fixing belt 20 becomes 150° C. to a time t1 at which the temperature lowers to 120° C. is less than 10 seconds, the flow enters Mode 1. In Mode 1, the fixing belt 20 is moved rotationally ten times at a rate of 50 mm/sec., while an electric power with a peak value of 900 W as shown in FIG. 7 is applied to a magnetization coil 25 (FIG. 2) from an exciting circuit 75 during a period from a time t1 to a time t2, and an operation of stopping the electric power application is carried out repetitively during a period from the time t2 to a time t3. By so doing, preheating control is carried out so that the belt temperature is rising and falling between the upper limit temperature Th of 130° C. and the lower limit temperature Tl of 110° C.

Referring to FIG. 6 again, when the operation in Mode 1 ends, the flow enters Mode 2, and preheating control according to Mode 2 is carried out (S608).

In Mode 2, in a state in which the rotational movement of the fixing belt 20 is stopped, as shown in FIGS. 7 and 8B, an electric power P0 with a peak value of 130 W is applied to the magnetization coil 25 (FIG. 2) from the exciting circuit 75 during a period from a time t1 to a time t2, and the application of the electric power is stopped during a period from the time t2 to a time t3. Then, an electric power P1 with a reduced peak value of 130×0.96 W is applied during a period from the time t3 to a time t4, and the application of the electric power is stopped during a period from the time t4 to a time t5. Then, at the time t5, the application of an electric power P2 with a reduced peak value of $130\times(0.96)^2$ W is started. Thus, an operation of starting and stopping the electric power application is carried out repetitively, with the applied electric power being reduced from one cycle to another. By so doing, preheating control is carried out so that the belt temperature is rising and falling between the upper limit temperature Th of 100° C. and the lower limit temperature Tl of 97° C. in the case of the NN environment, or between the upper limit temperature Th of 92° C. and the lower limit temperature Tl of 87° C. in the case of the LL environment.

In Mode 2, when the peak value of the applied electric power becomes not higher than 100 W, the flow enters Mode 3, and preheating control according to Mode 3 is carried out (S610).

In Mode 3, in a state in which the rotational movement of the fixing belt 20 is stopped, as shown in FIGS. 7 and 8B, an electric power P0 with a peak value of 100 W is applied to the magnetization coil 25 (FIG. 2) from the exciting circuit 75 during a period from a time t1 to a time t2, and the application of the electric power is stopped during a period from the time t2 to a time t3. Then, an electric power P1 with a reduced peak value of 100×0.96 W is applied during a period from the time t3 to a time t4, and the application of the electric power is stopped during a period from the time t4 to a time t5. Then, at the time t5, the application of an electric power P2 with a reduced peak value of $100\times(0.96)^2$ W is started. Thus, an operation of starting and stopping the electric power application is carried out repetitively, with the applied electric power being reduced from one cycle to another. By so doing, preheating control is carried out so that the belt temperature is rising and falling between the upper limit temperature Th of 100° C. and the lower limit temperature Tl of 97° C. in the case of the NN environment, or between the upper limit temperature Th of 92° C. and the lower limit temperature Tl of 87° C. in the case of the LL environment.

In Mode 3, when the peak value of the applied electric power becomes not higher than 60 W, the flow enters Mode 4, and preheating control according to Mode 4 is carried out (S611).

In Mode 4, in a state in which the rotational movement of the fixing belt 20 is stopped, the application of an electric power with a peak value of 60 W as shown in FIG. 7 and the suspension of the same are carried out alternately. By so doing, preheating control is carried out so that the belt temperature is rising and falling between the upper limit temperature Th of 100° C. and the lower limit temperature Tl of 97° C. in the NN environment, or between the upper limit temperature Th of 92° C. and the lower limit temperature of 87° C. in the LL environment.

Referring to FIG. 6 again, in the case where it is determined in Step S605 that the cooling time tp is not less than 10 seconds (No), the flow goes to Step S607, where it is determined whether the cooling time tp is is less than a cooling time $t_{M23}$ (for example, 20 seconds) as a reference for selecting either Mode 2 or Mode 3. In the case where it is determined in Step S607 that the cooling time tp is less than 20 seconds (Yes), preheating control according to Mode 2 is carried out (S608).

On the other hand, in the case where it is determined in Step S607 that the cooling time tp is not less than 20 seconds (No), the flow goes to Step S609, where it is determined whether the cooling time tp is less than a cooling time $t_{M34}$ (for example, 30 seconds) as a reference for selecting either Mode 3 or Mode 4. In the case where it is determined in Step S609 that the cooling time tp is less than 30 seconds (Yes), preheating control according to Mode 3 is carried out (S610).

On the other hand, in the case where it is determined in Step S609 that the cooling temperature tp is not less than 30 seconds (No), preheating control according to Mode 4 is carried out (S611).

By carrying out the preheating control as described above, an optimal preheating mode for the fixing belt 20 is selected according to a variation in the temperature of the fixing belt 20 (one of Modes 1, 2, 3, and 4 is selected according to the cooling time required for cooling from 150° C. to 120° C.), so that the fixing belt 20. and the heat-generating roller 21 are preheated in the selected mode during a stand-by period before the next image heating operation starts. This makes it possible to shorten the fast print time.

It should be noted that Mode 0 is shown in FIG. 7 in the present embodiment, which is a preheating mode corresponding to a case where the user opens a door of the image forming apparatus and closes the door so as to recover the apparatus during the stand-by period while the preheating is carried out. In such a case, when the door is opened, the application of an electric power to the fixing device is suspended for safety, and the temperature inside the image forming apparatus also falls according to the environment temperature, thereby causing the belt temperature to fall. In the case where the belt temperature is lower than 100° C., the preheating control according to Mode 0 is performed.

In Mode 0, the fixing belt 20 is heated gradually until the belt temperature becomes not lower than 100° C. by, for instance, repeating a four-second cycle with the electric power application during 0.5 second and the suspension of the same during 3.5 seconds (duty cycle: ⅛, applied electric *power*: 63 W equivalent) in the LL environment, or repeating a five-second cycle with the electric power application during 0.5 second and the suspension of the same during 4.5 seconds (duty cycle: *frax*;1;10, applied electric *power*: 50 W equivalent) in the NN environment. When the-belt temperature reaches 100° C., the flow enters Mode 2, where the preheating temperature control described above is carried out.

THIRD EMBODIMENT

Figure 9:
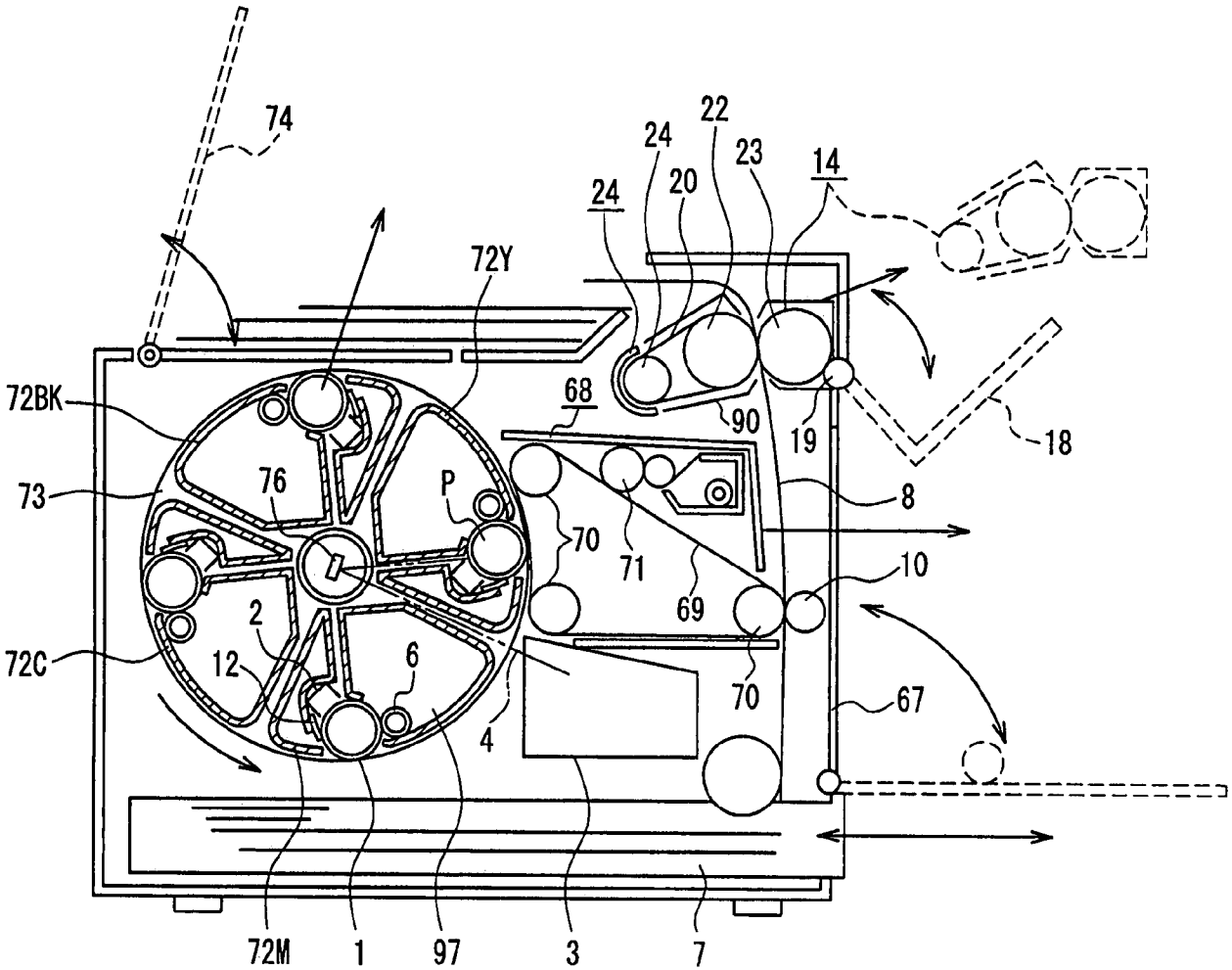
FIG. 9 is a cross-sectional view showing an overall configuration of a color image forming apparatus according to a third embodiment of the present invention, which uses as a fixing device an image heating device according to the first or second embodiment.

FIG. 9 is a cross-sectional view showing an overall configuration of a color image forming apparatus according to a third embodiment of the present invention, which uses as a fixing device an image heating device according to the first or second embodiment.

In FIG. 9, the right-hand face is the front face of the color image forming apparatus, on which a front door 67 is provided. Numeral 68 denotes a transfer belt unit including an intermediate transfer belt 69, three support axes 70 suspending the intermediate transfer belt 69, and a cleaner 71, which are formed in one piece and attached to the color image forming apparatus in a freely attachable and detachable manner. In this case, as shown in FIG. 9, the transfer belt unit 68 can be attached/detached to/from the color image forming apparatus after opening the front door 67.

On the left side of the interior of the color image forming apparatus, a carriage 73 is provided adjacent to the transfer belt unit 68. The carriage 73 may contain four annularly arranged image forming units 72BK, 72C, 72M, and 72Y for four colors, i.e., black (BK), cyan (C), magenta (M), and yellow (Y), respectively, each having a cross section of substantially wedge shape. The carriage 73 is rotatable in the arrow direction.

The image forming unit 72, which is formed in one piece with a photosensitive drum 1 and process elements arranged around the drum, includes the following components.

Numeral 2 denotes a corona charger for charging the photosensitive drum 1 with a homogeneous negative charge, numeral 97 denotes developing devices containing black toner, cyan toner, magenta toner, and yellow toner, respectively, for forming toner images of respective colors by supplying negatively charged toner from developing rollers 6 to an electrostatic latent image formed on the opposing photosensitive drum 1. In FIG. 9, numeral 3 denotes a laser beam scanner provided beneath the transfer belt unit 68.

The image forming units 72BK to 72Y can be attached/detached to/from the color image forming apparatus by opening a top door 74 on a top face of the color image forming apparatus. When the carriage 73 rotates, the image forming units 72BK, 72C, 72M, and 72Y rotate around a fixed mirror 76. During image formation, the image forming units 72BK, 72C, 72M, and 72Y are shifted sequentially to the image forming position P opposing the intermediate transfer belt 69.

An operation of the color image forming apparatus configured as above will be described in the following.

First, the carriage 73 is rotated to shift the image forming unit 72Y for the first color yellow to the image forming position P (a state illustrated in FIG. 9). In this state, a laser beam 4 emitted from the laser beam scanner 3 passes through the portion between the image forming units 72Y and the image forming units 72M for magenta and is then reflected by the mirror 76 to enter the photosensitive drum 1 that is at the image forming position P. Thus, an electrostatic latent image is formed on the photosensitive drum 1. This electrostatic latent image is developed by yellow toner conveyed to the developing roller 6 of the developing device 97 opposing the photosensitive drum 1, thereby forming a toner image on the photosensitive drum 1. Subsequently, the yellow toner image formed on the photosensitive dram 1 is transferred (which is a primary transfer) to the intermediate transfer belt 69.

After the formation of the yellow toner image is completed, the carriage 73 is rotated 90° in the arrow direction to shift the image forming unit 72M for magenta to the image forming position P. Then, an image forming operation is performed in the same manner as for yellow, thereby forming a magenta toner image so as to overlap the yellow toner image on the intermediate transfer belt 69. The same image forming operations are repeated for cyan and black in this order, so that a toner image including the toner images of four colors overlapped with each other are formed on the intermediate transfer belt 69.

The transfer roller 10 is brought into contact with the intermediate transfer belt 69 in synchronization with the top position of the forth black toner image on the intermediate transfer belt 69 comes. Subsequently, a recording sheet 8 is fed to the nip portion formed between the transfer roller 10 and the intermediate transfer belt 69, thereby transferring (which is a secondary transfer) the toner image of four colors onto the recording sheet 8. The recording sheet 8 onto which the toner image has been transferred passes through the fixing device 14 to fix the toner image thereon and then is ejected to the outside of the color image forming apparatus. Toner remaining on the intermediate transfer belt 69 after the secondary transfer is removed by the cleaner 71, which separates from and contacts with the intermediate transfer belt 69 with suitable timing.

After image formation on a sheet of paper is completed, the image forming unit 72Y for yellow is shifted to the image forming position P, thus completing the preparation for subsequent image formation.

In the present embodiment, the fixing belt 20 may include a polyimide resin of 90 μm thickness as a base, onto which silicone rubber of 150 μm thickness is laminated. The fixing belt 20 is tensioned in the direction in which the fixing device 14 is attached/detached to/from the color image forming apparatus main body.

As shown in FIG. 9, in the fixing device 14, the heat-generating roller 21, the fixing roller 22, and the pressure roller 23 can be attached/detached to/from the color image forming apparatus main body as one unit while leaving the magnetization means 24 in the image forming apparatus main body. The direction in which the fixing belt 20 is tensioned and the direction in which the opening of the magnetization means 24 with a semicircular cross section is opened coincide with the direction in which the fixing device 14 is attached/detached to/from the color image forming apparatus main body. As a result, the magnetization means 24 and the heat-generating roller 21 do not interfere with each other, which allows easy attachment/detachment of the fixing device 14. The attachment/detachment of the fixing device 14 can be performed by opening/closing a fixing door 18.

Although the above-described respective embodiments are directed to the configuration in which the heat-generating roller 21 generates heat through electromagnetic induction, thereby indirectly heating the fixing belt 20, the present invention is not limited to this configuration. For example, it is also possible to use a conductive fixing belt 20 and heat the conductive fixing belt 20 directly through electromagnetic induction. In this case, the conductive fixing belt 20 may be a belt including a belt base fabricated by electroforming with nickel, which is 30 μm in thickness and 60 mm in diameter, onto which silicone rubber of 150 μm thickness has been formed for fixing color images, for example.

The above-described respective embodiments are directed to the case where the cover 90 for making the temperature of the fixing belt 20 detected by the temperature sensor 45 coincide with the temperature of the atmosphere in the vicinity of the temperature sensor 45 is attached to the image heating device. However, the cover 90 may be attached to the image forming apparatus in the state where the image heating device is detached therefrom so that the cover 90 encloses the space occupied by the fixing belt 20, the temperature sensor 45, and the pressure roller 23 when the image heating device is attached to the image forming apparatus.

As described above, according to the present invention, a temperature sensor for detecting the temperature of the pressure roller is omitted, whereby the cost is reduced, and hence, the temperature of the pressure roller is estimated according to the temperature of the belt and a variation in the temperature of the same, so as to set an optimal fixing temperature for a subsequent image heating operation. By so doing, differences in gloss among fixed images on recording media that occur due to a temperature fluctuation of the pressure roller, and the wrapping of the fixing belt at a high temperature can be prevented.

Furthermore, an optimal preheating operation requiring a minimum belt rotation is performed according to a variation in the temperature of the belt, during a stand-by time until a subsequent image heating operation is started. By so doing, the fast print time can be shortened with the reduction of noise and the energy saving taken into consideration.

The invention may be embodied in other forms without departing from the spirit or essential characteristics thereof. The embodiments disclosed in this application are to be considered in all respects as illustrative and not limiting. The scope of the invention is indicated by the appended claims rather than by the foregoing description, and all changes which come within the meaning and range of equivalency of the claims are intended to be embraced therein.

What is claimed is:

1. An image heating device comprising a movable heating member for directly heating a material to be heated;

heat-generating means for directly or indirectly heating the heating member;

pressing means arranged in contact with the heating member;

a temperature sensor for detecting a temperature of the heating member; and controlling means for controlling an amount of heat generated by the heat-generating means according to the temperature of the heating member detected by the temperature sensor so that the heating member has a set temperature, wherein the controlling means determines a preheating mode for the heating member in a stand-by period until a subsequent start of image heating, according to at least one of the detected temperature of the heating member and a variation with time in the detected temperature after the heating of the heating member by the heat-generating means is stopped.

2. The image heating device according to claim 1, wherein the heating member is at least partially conductive, and the heat-generating means includes a magnetization means that directly heats the heating member through electromagnetic induction.

3. The image heating device according to claim 1, wherein the heat-generating means includes:

a rotatable heat-generating member for indirectly heating the heating member, the heat-generating member being at least partially conductive and arranged in contact with an inner peripheral surface of the heating member; and magnetization means that heats the heating member through electromagnetic induction.

4. The image heating device according to claim 1, wherein the heating member is in a belt form.

5. The image heating device according to claim 1, wherein the heating member has a thermal capacity of not more than 60 J/K.

6. The image heating device according to claim 1, wherein the heating member has a thermal capacity of not more than 40 J/K.

7. The image heating device according to claim 1, wherein, in the case where the variation with time in the detected temperature of the heating member exceeds a predetermined value, the controlling means selects as the preheating mode a first preheating mode in which application of electric power to the heat-generating means and suspension of the same are carried out in a state in which the heating member is moved, so that the detected temperature by the temperature sensor rises and falls between a predetermined upper limit temperature and a predetermined limit temperature.

8. The image heating device according to claim 7, wherein the controlling means continuously maintains the state in which the heating member is moved, during a predetermined period.

9. The image heating device according to claim 7, wherein the controlling means sets an electric power applied to the heat-generating means so that the electric power has a maximum peak value upon the application of the same.

10. The image heating device according to claim 1, wherein, in the case where the variation with time in the detected temperature of the heating member does not exceed a predetermined value, the controlling means selects as the preheating mode a second preheating mode in which application of electric power to the heat-generating means and suspension of the same are carried out in a state in which moving of the heating member is stopped, so that the detected temperature by the temperature sensor rises and falls between a predetermined upper limit temperature and a predetermined lower limit temperature.

11. The image heating device according to claim 10, wherein the controlling means varies the upper limit temperature and the lower limit temperature according to environmental conditions.

12. The image heating device according to claim 11, wherein the controlling means varies a peak value of the electric power applied to the heat-generating means according to a variation with time in the detected temperature of the heating member.

13. The image heating device according to claim 11, wherein, each time the application of the electric power to the heat-generating means and the suspension of the same are repeated, the controlling means reduces a peak value of the electric power applied to the heat-generating means with a certain scaling factor.

14. The image heating device according to claim 11, wherein the controlling means varies a peak value of the electric power applied to the heat-generating means according to environmental conditions.

15. The image heating device according to claim 10, wherein the controlling means varies a peak value of the electric power applied to the heat-generating means according to a variation with time in the detected temperature of the heating member.

16. The image heating device according to claim 10, wherein, each time the application of the electric power to the heat-generating means and the suspension of the same are repeated, the controlling means reduces a peak value of the electric power applied to the heat-generating means with a certain scaling factor.

17. The image heating device according to claim 10, wherein the controlling means varies a peak value of the electric power applied to the heat-generating means according to environmental conditions.

18. The image heating device according to claim 1, wherein, in the case where the variation with time in the detected temperature of the heating member is within a predetermined range, the controlling means selects as the preheating mode a third preheating mode in which application of an electric power to the heat-generating means and suspension of the same in a state in which moving of the heating member is stopped, and the moving of the heating member, are carried out alternately.

19. The image heating device according to claim 1, further comprising a cover for enclosing a space occupied by at least a part of the heating member, the temperature sensor, and the pressing means excluding a path portion through which the material to be heated passes, so as to make the temperature of the heating member detected by the temperature sensor substantially coincide with an ambient temperature in the vicinity of the temperature sensor.

20. The image heating device according to claim 18, wherein the controlling means varies a peak value of the electric power applied to the heat-generating means according to a variation with time in the detected temperature of the heating member.

21. The image heating device according to claim 18, wherein, each time the application of the electric power to the heat-generating means and the suspension of the same are repeated, the controlling means reduces a peak value of the electric power applied to the heat-generating means with a certain scaling factor.

22. The image heating device according to claim 18, wherein the controlling means varies a peak value of the electric power applied to the heat-generating means according to environmental conditions.

23. An image forming apparatus comprising:

image forming means for forming an unfixed toner image onto a recording medium as an material to be heated and having the unfixed image carried thereon; and a fixing device for thermally fixing the toner image onto the recording medium, the fixing device including:

a movable heating member for directly heating the material to be heated;

heat-generating means for directly or indirectly heating the heating member;

pressing means arranged in contact with the heating member;

a temperature sensor for detecting a temperature of the heating member; and controlling means for controlling an amount of heat generated by the heat-generating means according to the temperature detected by the temperature sensor so that the heating member has a set temperature, wherein the controlling means is an image heating device that determines a preheating mode for the heating member in a stand-by period until a subsequent start of image heating, according to at least one of the detected temperature of the heating member and a variation with time in the detected temperature after the heating of the heating member by the heat-generating means is stopped.

24. An image forming apparatus comprising:

image forming means for forming an unfixed toner image onto a recording medium as a material to be heated and having the unfixed image carried thereon;

a removable fixing device for thermally fixing the toner image onto the recording medium, the fixing device including:

a movable heating member for directly heating a material to be heated;

heat-generating means for directly or indirectly heating the heating member;

pressing means arranged in contact with the heating member;

a temperature sensor for detecting a temperature of the heating member; and controlling means for controlling an amount of heat generated by the heat-generating means according to the temperature of the heating member detected by the temperature sensor so that the heating member has a set temperature, wherein the controlling means is an image heating device that determines a preheating mode for the heating member in a stand-by period until a subsequent start of image heating, according to at least one of the detected temperature of the heating member and a variation with time in the detected temperature after the heating of the heating member by the heat-generating means is stopped; and a cover for enclosing a space occupied by at least a part of the heating member, the temperature sensor, and the pressing means excluding a path portion through which the material to be heated passes when the fixing device is attached, so as to make the temperature of the heating member detected by the temperature sensor substantially coincide with an ambient temperature in the vicinity of the temperature sensor.

25. An image copying machine comprising:

an image reading apparatus including image reading means for reading an original image; and an image forming apparatus, the image forming apparatus including:

image forming means for forming an unfixed toner image according to the original image read by the image reading apparatus onto a recording medium as a material to be heated, and having the unfixed image carried thereon; and a fixing device for thermally fixing the toner image on the recording medium, the fixing device including:

a movable heating member for directly heating the material to be heated;

heat-generating means for directly or indirectly heating the heating member;

pressing means arranged in contact with the heating member;

a temperature sensor for detecting a temperature of the heating member; and controlling means for controlling an amount of heat generated by the heat-generating means according to the temperature detected by the temperature sensor so that the heating member has a set temperature, wherein the controlling means is an image heating device that determines a preheating mode for the heating member in a stand-by period until a subsequent start of image heating, according to at least one of the detected temperature of the heating member and a variation with time in the detected temperature after the heating of the heating member by the heat-generating means is stopped.

26. An image copying machine comprising:

an image reading apparatus including image reading means for reading an original image; and an image forming apparatus, the image forming apparatus including:

image forming means for forming an unfixed toner image according to the original image read by the image reading apparatus onto a recording medium as a material to be heated, and having the unfixed image carried thereon;

a removable fixing device for thermally fixing the toner image onto the recording medium, the fixing device including:

a movable heating member for directly heating a material to be heated;

heat-generating means for directly or indirectly heating the heating member;

pressing means arranged in contact with the heating member;

a temperature sensor for detecting a temperature of the heating member; and controlling means for controlling an amount of heat generated by the heat-generating means according to the temperature of the heating member detected by the temperature sensor so that the heating member has a set temperature, wherein the controlling means is an image heating device that determines a preheating mode for the heating member in a stand-by period until a subsequent start of image heating, according to at least one of the detected temperature of the heating member and a variation with time in the detected temperature after the heating of the heating member by the heat-generating means is stopped; and a cover for enclosing a space occupied by at least a part of the heating member, the temperature sensor, and the pressing means excluding a path portion through which the material to be heated passes when the fixing device is attached, so as to make the temperature of the heating member detected by the temperature sensor substantially coincide with an ambient temperature in the vicinity of the temperature sensor.

27. A temperature controlling method applicable to an image heating device, the image heating device including:

a movable heating member for directly heating the material to be heated; heat-generating means for directly or indirectly heating the heating member;

pressing means arranged in contact with the heating member;

a temperature sensor for detecting a temperature of the heating member;

controlling means for controlling an amount of heat generated by the heat-generating means according to the temperature detected by the temperature sensor so that the heating member has a set temperature; and a cover for enclosing a space occupied by at least a part of the heating member, the temperature sensor, and the pressing means excluding a path portion through which the material to be heated passes, so as to make the temperature of the heating member detected by the temperature sensor substantially coincide with an ambient temperature in the vicinity of the temperature sensor, the method comprising the steps of:

measuring at least one of the temperature of the heating member and a variation with time in the temperature of the heating member after the heating of the heating member by the heat-generating means is stopped, by using the temperature sensor;

determining a preheating mode for the heating member in a stand-by period until a subsequent start of image heating, according to at least one of the detected temperature of the heating member and a variation with time in the detected temperature measured in the measuring step; and preheating the heating member according to the preheating mode determined in the preheating mode determining step.

28. A temperature controlling method applicable to an image forming apparatus, the image forming apparatus including:

image fanning means for forming an unfixed toner image onto a recording medium as a material to be heated and having the unfixed image carried thereon;

a removable image heating device for thermally fixing the toner image onto the recording medium, the image heating device including:

a movable heating member for directly heating the material to be heated;

heat-generating means for directly or indirectly healing the heating member;

pressing means arranged in contact with the heating member;

a temperature sensor for detecting a temperature of the heating member; and controlling means for controlling an amount of heat generated by the heat-generating means according to the temperature detected by the temperature sensor so that the heating member has a set temperature; and a cover for enclosing a space occupied by at least a part of the heating member, the temperature sensor, and the pressing means excluding a path portion through which the material to be heated passes when the image heating device is attached, so as to make the temperature of the heating member detected by the temperature sensor substantially coincide with an ambient temperature in the vicinity of the temperature sensor, the method comprising the steps of:

measuring at least one of the temperature of the heating member and a variation with time in the temperature of the heating member after the heating of the heating member by the heat-generating means is stopped, by using the temperature sensor;

determining a preheating mode for the heating member in a stand-by period until a subsequent start of image heating, according to at least one of the detected temperature of the heating member and the variation with time in the detected temperature measured in the measuring step; and preheating the heating member according to the preheating mode determined in the preheating mode determining step.

* * * * *

UNITED STATES PATENT AND TRADEMARK OFFICE

CERTIFICATE OF CORRECTION

PATENT NO. : 7,062,188 B2
APPLICATION NO. : 11/191590
DATED : June 13, 2006
INVENTOR(S) : Tatematsu et al.

It is certified that error appears in the above-identified patent and that said Letters Patent is hereby corrected as shown below:

Column 27, line 17(claim 7): “predetermined limit” should read --predetermined lower limit--
Column 27, line 31(claim 10): “a second preheating” should read --a preheating--
Column 28, line 11(claim 18): “a third preheating” should read --a preheating--
Column 31, line 19(claim 28): “fanning” should read --forming--

Signed and Sealed this

Sixth Day of February, 2007

JON W. DUDAS
*Director of the United States Patent and Trademark Office*